US011422481B2

(12) United States Patent
Murakami

(10) Patent No.: US 11,422,481 B2
(45) Date of Patent: Aug. 23, 2022

(54) IMAGE FORMING APPARATUS AND IMAGE FORMING METHOD

(71) Applicant: Masatoshi Murakami, Kanagawa (JP)

(72) Inventor: Masatoshi Murakami, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/305,172

(22) Filed: Jul. 1, 2021

(65) Prior Publication Data

US 2022/0004114 A1 Jan. 6, 2022

(30) Foreign Application Priority Data

Jul. 6, 2020 (JP) ..... JP2020-116364

(51) Int. Cl.
*G03G 15/01* (2006.01)
*G03G 15/043* (2006.01)
*G03G 15/00* (2006.01)

(52) U.S. Cl.
CPC ..... *G03G 15/0184* (2013.01); *G03G 15/043* (2013.01); *G03G 15/5054* (2013.01); *G03G 2215/0158* (2013.01)

(58) Field of Classification Search
CPC ..... G03G 15/0184; G03G 15/043; G03G 15/5054; G03G 15/5058; G03G 2215/0158; G03G 2215/0161
See application file for complete search history.

(56) References Cited

U.S. PATENT DOCUMENTS

2014/0002564 A1* 1/2014 Miyadera ..... G03G 15/5058 347/118
2014/0152754 A1 6/2014 Murakami et al.
2014/0153010 A1 6/2014 Miyadera et al.
2014/0153943 A1 6/2014 Miyadera et al.
2015/0125170 A1 5/2015 Shirasaki et al.
2015/0139702 A1 5/2015 Murakami et al.
2015/0261118 A1 9/2015 Murakami et al.
2015/0261121 A1 9/2015 Kawanabe et al.
(Continued)

FOREIGN PATENT DOCUMENTS

JP 2001-034026 2/2001
JP 2012-053190 3/2012
JP 2019-211579 12/2019

OTHER PUBLICATIONS

Extended European Search Report for 21183911.3 dated Nov. 22, 2021.

*Primary Examiner* — Sophia S Chen
(74) *Attorney, Agent, or Firm* — IPUSA, PLLC

(57) ABSTRACT

An image forming apparatus superimposes a plurality of color images each formed of a single-color developer to form a superimposed color image. The image forming apparatus includes a transfer belt and processing circuitry. The processing circuitry forms, as a correction pattern, combination patterns arranged along a conveyance direction of the color images and including a first pattern, a second pattern, and a third pattern. A formation interval of the first pattern constituting one combination pattern is shorter than a formation interval between one horizontal line of the first pattern constituting the one combination pattern and another horizontal line of the first pattern constituting another combination pattern. The one horizontal line is opposite the other horizontal line.

20 Claims, 17 Drawing Sheets

(56) References Cited

U.S. PATENT DOCUMENTS

| | | | | |
|---|---|---|---|---|
| 2015/0331377 | A1* | 11/2015 | Fujita | G03G 15/5058 399/406 |
| 2015/0338809 | A1* | 11/2015 | Omura | G03G 15/043 399/301 |
| 2015/0346626 | A1 | 12/2015 | Kohri et al. | |
| 2016/0077461 | A1 | 3/2016 | Yamaguchi et al. | |
| 2016/0109822 | A1 | 4/2016 | Kohri et al. | |
| 2018/0246436 | A1* | 8/2018 | Omura | G03G 15/5058 |
| 2019/0369518 | A1 | 12/2019 | Murakami et al. | |

* cited by examiner

IMAGE FORMING APPARATUS AND IMAGE FORMING METHOD

CROSS-REFERENCE TO RELATED APPLICATION

This patent application is based on and claims priority pursuant to 35 U.S.C. § 119(a) to Japanese Patent Application No. 2020-116364, filed on Jul. 6, 2020 in the Japan Patent Office, the entire disclosure of which is hereby incorporated by reference herein.

BACKGROUND

Technical Field

Embodiments of the present disclosure relate to an image forming apparatus and an image forming method.

Related Art

As an electrophotographic image forming apparatus, there is known a tandem-type electrophotographic image forming apparatus. A tandem-type color image forming apparatus forms electrostatic latent images on photoconductive members corresponding to a plurality of color developing materials (toners) of different colors by using an optical writing control technique, and causes the color developing materials of the different colors to adhere to the electrostatic latent images to develop the electrostatic latent image, thus forming the different color images. The different color images are transferred onto a transfer body so as to be superimposed one on top of another to form a color image.

If a superimposed position of each color image is deviated in a tandem type color image forming apparatus, color registration deviation occurs in a final color image. For this reason, in recent years in which high-resolution and high-quality image formation is required, there is a demand for highly accurately restraining a deviation in the superimposed position of each color image, in other words, "positional deviation".

Although there are many causes of positional deviation, a main cause is a physical configuration that operates to execute an image forming process including a transfer process of each color image. In other words, it is considered that the positional deviation occurs due to the fluctuation of the operation of, e.g., an intermediate transfer belt that transfers and superimposes the respective color images, for example, the speed fluctuation of the rotational driving. When the image forming process including the transfer process is performed, a large number of endless rotating bodies are used. Examples of the endless rotating bodies include a photoconductive member, a charging roller that charges the photoconductive member, an intermediate transfer belt serving as a transfer member, a transfer roller that transfers a color image formed on the intermediate transfer belt to a recording medium, and gears used in a drive mechanism for rotating the foregoing members. If the rotation operations (rotation timing and rotation speed) of such a large number of endless rotating bodies are all in an ideally adjusted state and such an ideal state is maintained, it is considered that the occurrence of positional deviation can be restrained. However, actually, there is "fluctuation" in the rotation operation of each endless rotating body and the rotation speed periodically fluctuates. For this reason, on the premise of the occurrence of the positional deviation due to the speed fluctuations of the endless rotating bodies, a technology for reducing the positional deviation is needed.

Hence, for the purpose of reducing positional deviation, for example, a technology has been used in which an image forming process is executed to form a detection pattern including a specific image pattern on a transfer body, and the control of an operation of transferring an actual image of each color is corrected based on a result of detection of the detection pattern by a sensor. In such a case, a detection pattern is formed over the entire length of the intermediate transfer belt to cancel out the influence of periodic speed fluctuations, and the detection results are averaged to calculate a correction value. In other words, the correction value is calculated after all the detection patterns formed on the intermediate transfer belt whose longest length corresponds to one cycle are detected. Accordingly, it takes time to calculate the correction value, and there is a disadvantage in terms of efficiency in the control for restraining the positional deviation.

SUMMARY

In an aspect of the present disclosure, there is provided an image forming apparatus to superimpose a plurality of color images each formed of a single-color developer to form a superimposed color image. The image forming apparatus includes a transfer belt and processing circuitry. The processing circuitry forms a correction pattern on the transfer belt. The correction pattern is for calculating a correction value used for a correction operation of correcting a positional deviation of each of the plurality of color images occurring when the plurality of color images are superimposed one on top of another onto the transfer belt. The transfer belt is at least one of endless rotating bodies used to superimposing processing of the plurality of color images. The processing circuitry detects the correction pattern formed on the transfer belt and calculate the correction value based on a detection result of the correction pattern. The processing circuitry forms, as the correction pattern, a plurality of combination patterns arranged along a conveyance direction of the plurality of color images, the plurality of combination patterns including a first pattern, a second pattern, and a third pattern. The first pattern includes horizontal lines arranged along the conveyance direction and parallel to a direction orthogonal to the conveyance direction, the second pattern includes horizontal lines arranged along the conveyance direction and parallel to the direction orthogonal to the conveyance direction, and the third pattern includes diagonal lines arranged along the conveyance direction and inclined with respect to the conveyance direction and the direction orthogonal to the conveyance direction, the third pattern having a same color as the second pattern. In each combination pattern of the plurality of combination patterns, one of a horizontal line of the second pattern and a diagonal line of the third pattern is placed between horizontal lines of the first pattern spaced away from each other in the conveyance direction. The other one of the horizontal line of the second pattern and the diagonal line of the third pattern is not included in one combination pattern of the plurality of combination patterns formed on the transfer belt and another combination pattern of the plurality of combination patterns formed ahead of or behind the one combination pattern in the conveyance direction and is placed between the one combination pattern and said another combination pattern. A formation interval of the first pattern constituting the one combination pattern is shorter than a formation interval between one horizontal line of the first pattern constituting the one combination pattern and another horizontal line of the first pattern constituting said another combination pattern, the one horizontal line being opposite said another horizontal line.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
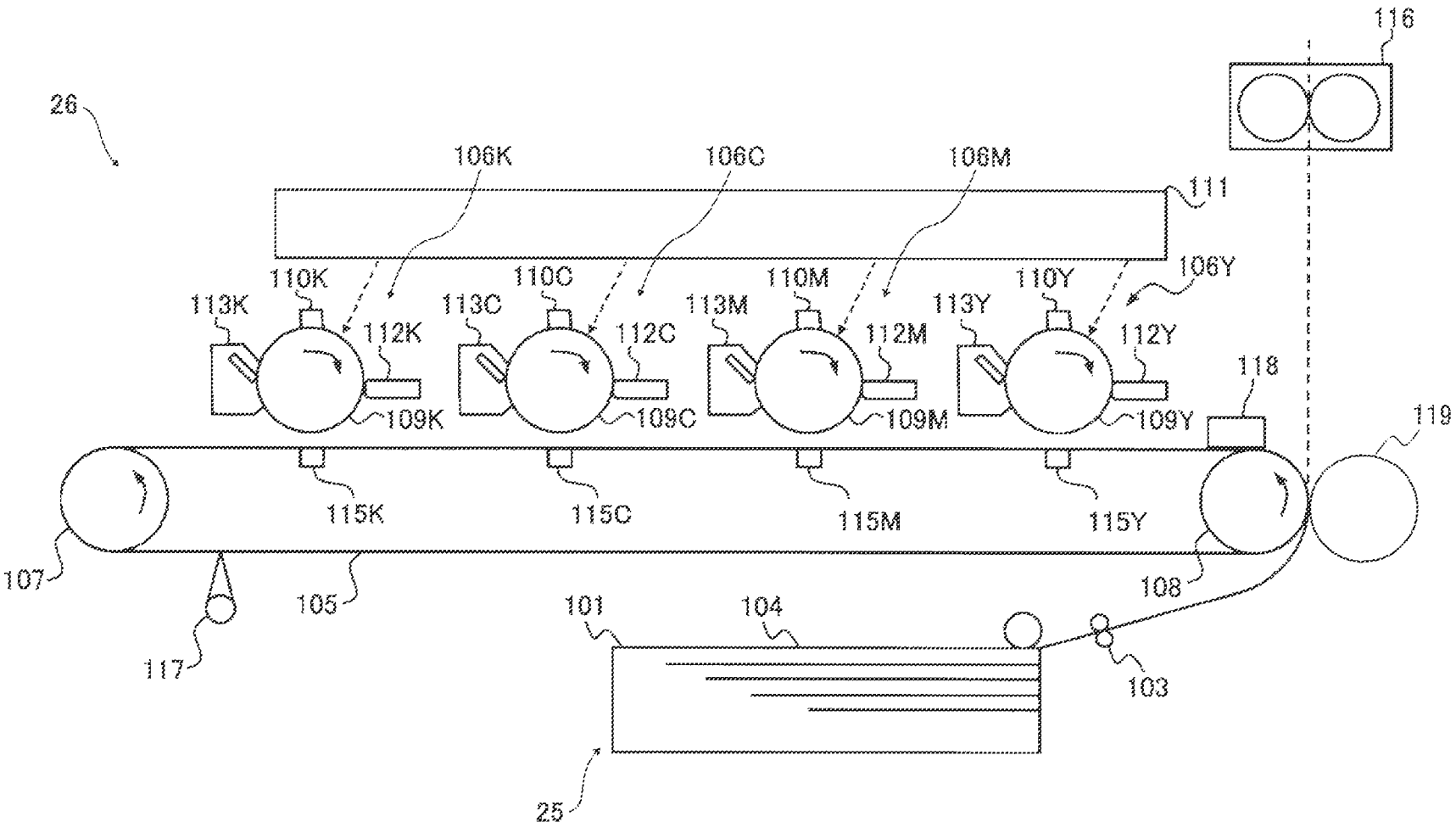
FIG. 1 is a schematic view of a multifunction peripheral (MFP) as an image forming apparatus according to an embodiment of the present disclosure.

The accompanying drawings are intended to depict embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Hereinafter, embodiments of an image forming apparatus and an image forming method according to an embodiment of the present disclosure are described with reference to drawings. As an embodiment according to the present disclosure, a description is given below of a "method of forming a detection pattern" used for correcting a positional deviation at the time of superimposing color images in an image forming apparatus that superimposes the color images to form a composite color image. The detection pattern is an image formed on a transfer body through an optical writing process and is used to calculate a correction value for correcting a writing position in the optical writing process according to a result of detecting the detection pattern with the sensor. In other words, the image forming apparatus according to an embodiment the present disclosure has a function of highly accurately calculating a correction value for effectively reducing a positional deviation, using a detection pattern formed by a characteristic method.

Here, the "method of forming the detection pattern" refers to the shape, arrangement, color, and their combination of elements constituting the detection pattern in the formation of the detection pattern. In other words, the detection pattern is formed by a combination of a plurality of image elements. Therefore, the formation of the detection pattern means that image elements having different shapes or colors are formed based on a specific arrangement manner so that a correction value for effectively reducing the positional deviation can be calculated with high accuracy.

Outline of Detection Pattern

Figure 17:
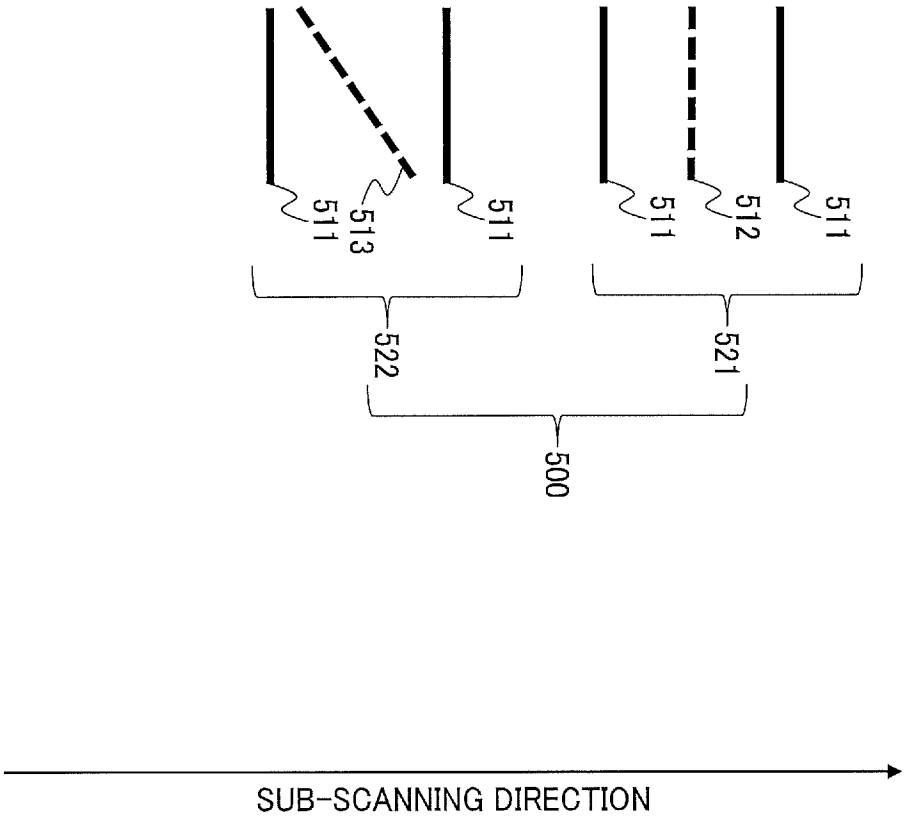
FIG. 17 is a diagram illustrating an outline of a correction pattern formed in the MFP of FIG. 1.

First, a description is given of an outline of a detection pattern formed in an image forming apparatus according to an embodiment of the present disclosure. FIG. 17 is an illustration of an example of components of a correction pattern 500 as a detection pattern according to the present embodiment. The correction pattern 500 is formed by a combination of a plurality of line images.

The correction pattern 500 includes a reference pattern 511, a horizontal line pattern 512, and a diagonal line pattern 513. The reference pattern 511 is a first pattern formed of straight lines (or horizontal lines) of a reference color. The straight lines extend in a main scanning direction as a direction orthogonal to a sub-scanning direction as a conveyance direction of a recording medium and arranged along the sub-scanning direction. The horizontal line pattern 512 is a second pattern formed of a straight line extending in the main scanning direction and having a color to be corrected. The diagonal line pattern 513 is a third pattern formed of a straight line (diagonal line) inclined with respect to the main scanning direction (and the sub-scanning direction) and has a color to be corrected.

A first combination pattern 521 and a second combination pattern 522 are distinguished based on how the first pattern, the second pattern, and the third pattern are combined. In the first combination pattern 521, two horizontal lines of the reference pattern 511 as the first pattern and a horizontal line of the horizontal line pattern 512 as the second pattern are arranged along the sub-scanning direction as the conveyance direction. The horizontal line of the horizontal line pattern 512 as the second pattern is disposed between the two horizontal lines of the reference pattern 511 to constitute a set of detection patterns. Similarly, in the second combination pattern 522, two horizontal lines of the reference pattern 511 as the first pattern and a diagonal line of the diagonal line pattern 513 as the third pattern are arranged along the sub-scanning direction. The diagonal line of the diagonal line pattern 513 as the third pattern is disposed between the two reference patterns 511 to constitute a set of detection patterns. The sets of detection patterns are appropriately arranged and formed along the sub-scanning direction.

In any of the first combination pattern 521 and the second combination pattern 522, two horizontal lines of the reference pattern 511 are used. The color of a color developer used for forming the reference pattern 511 is a color set as a reference color. The reference color is, for example, black. In other words, the plurality of reference patterns 511 used for the first combination pattern 521 and the second combination pattern 522 are all formed in, for example, "black".

The color of the color developer used when forming the horizontal line pattern 512 included in the first combination pattern 521 and the diagonal line pattern 513 included in the second combination pattern 522 is a color to be corrected, in other words, a correction target color. In the present embodiment, the color to be corrected is any one of yellow (Y), magenta (M), cyan (C), and black (K) used as the color of the color developer as described later. For example, in the case of the correction pattern 500 used for calculating the correction value for reducing the positional deviation related to the magenta color, the correction pattern includes a first combination pattern 521 in which a horizontal line pattern 512 of the correction target color (magenta color) is arranged between two horizontal lines of a reference pattern 511 of the reference color (black) and a second combination pattern 522 in which a diagonal line pattern 513 of the correction target color (magenta color) is arranged between other two horizontal lines of the reference pattern 511 of the reference color (black). Note that the first combination pattern 521 is a pattern in which three straight lines extending in the main scanning direction are formed side by side along the sub-scanning direction, and has a shape similar to the Chinese numeral "three", which may be referred to as a "three-parallel-line pattern". The second combination pattern 522 is a pattern in which straight lines extending in the main scanning direction are arranged at intervals in the sub-scanning direction and a diagonal line is arranged between the two straight lines, and may be referred to as a "Z pattern" since the pattern has a shape similar to the Roman character "Z".

In the following description of the present embodiment, the second combination pattern 522 may be simply referred to as "Z pattern". The first combination pattern 521 may be referred to as "three-parallel-line pattern".

Figure 15:
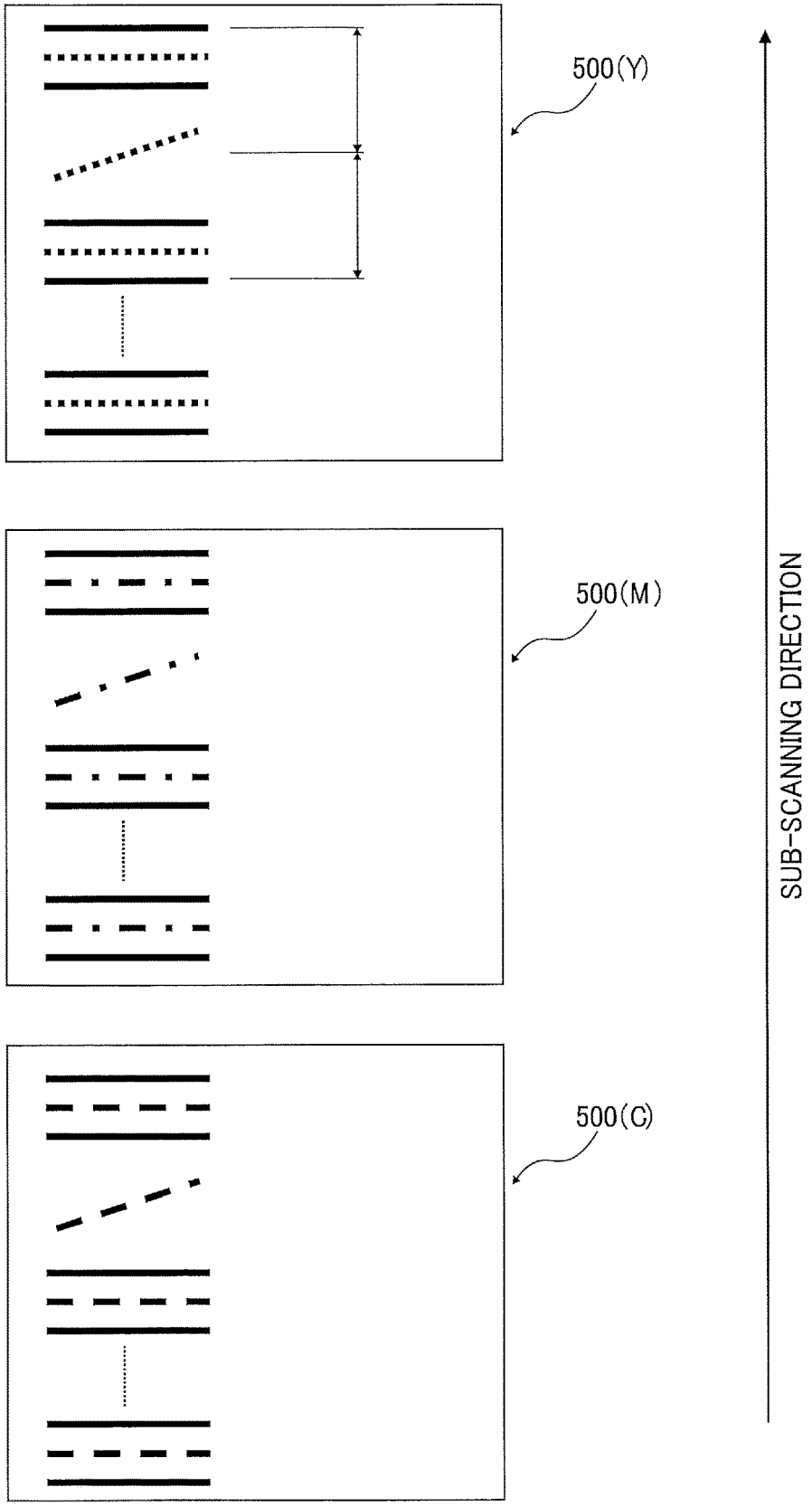
FIG. 15 is a diagram illustrating a second example of a correction pattern formed in the MFP of FIG. 1.

The horizontal line pattern 512 and the diagonal line pattern 513 illustrated in FIG. 15 are drawn by broken lines used to express magenta color in this embodiment. Note that the reference pattern 511 is formed of a reference color and black is used as the reference color in the present embodiment. However, the reference color is not limited to black and may be any other color. In this embodiment, black is drawn by a straight line.

In the image forming apparatus according to the present embodiment, the alignment process can be repeatedly executed. Therefore, when attention is focused on a detection pattern used when one cycle of the alignment process, that is, one correction operation is executed, the reference pattern 511 is formed in the same color (reference color). The horizontal line pattern 512 and the diagonal line pattern 513 arranged between the reference patterns 511 are formed in the same correction target color.

The "one round of alignment process" refers to a pattern detection process for calculating a correction value for correcting a positional deviation and a pattern forming process performed using the calculated correction value. The color of the reference pattern 511 is set to the same color in one round of alignment. Such a configuration allows the phase component of the deviation of the formation position of the reference pattern 511 to be uniformed by the fluctuation of the rotation speed of the endless rotating body. Uniformizing the phase component of the deviation can enhance the alignment accuracy.

If the reference patterns 511 of two or more colors are used, it would be necessary to provide a pattern interval when the colors of the reference patterns 511 are switched. However, when the reference patterns 511 of the same color are used, it is not necessary to provide such an interval. Thus, the length (total pattern length) of the correction pattern 500 formed by a set of the first combination pattern 521 and the second combination pattern 522 can be shortened.

Image Forming Apparatus According to Embodiment

A description is given below of an image forming apparatus including an optical writing device according to an embodiment of the present disclosure. FIG. 1 is a perspective view of a multifunction peripheral (MFP) as an image forming apparatus according to an embodiment of the present disclosure. As illustrated in FIG. 1, an MFP 100 as the image forming apparatus according to the present embodiment includes an intermediate transfer belt 105 and image forming units 106. The intermediate transfer belt 105 is one of endless rotating bodies and is a transfer body to which color images of black (K), cyan (C), magenta (M), and yellow (Y) are transferred. The image forming units 106 as image forming devices or image forming means corresponding to the respective colors are arranged along the intermediate transfer belt 105. The MFP 100 illustrated in FIG. 1 is referred to as a tandem type. The intermediate transfer belt 105 is a conveyor or conveying means of a recording medium on which an image is formed. The rotation direction of the intermediate transfer belt 105 is a conveyance direction of a correction pattern 500 formed on the intermediate transfer belt 105.

The image forming unit 106 is an electrophotographic process unit and has a configuration used for forming an image of each color. For example, the image forming apparatus includes a yellow image forming unit 106Y to form a yellow (Y) image, a magenta image forming unit 106M to form a magenta (M) image, a cyan image forming unit 106C to form a cyan (C) image, and a black image forming unit 106K to form a black (K) image. Hereinafter, these units are collectively referred to as image forming units 106. The image forming units 106 are disposed along a rotation direction of rotation of the intermediate transfer belt 105, in other words, a conveyance direction of a transferred image. The image forming unit 106 is different only in the color of a color developer (or toner) used for developing an electrostatic latent image, and has the same internal configuration.

Hereinafter, the yellow image forming unit 106Y is described in detail. However, each component corresponding to any other color may be simply indicated by reference numerals distinguished by M, C, and K instead of Y attached to each component of the yellow image forming unit 106Y in drawings.

The intermediate transfer belt 105 is an intermediate transfer unit or intermediate transfer means, and is an endless belt member, that is, an endless rotating body, stretched between a driving roller 108 and a driven roller 107. Color images are transferred from the image forming units 106 onto the intermediate transfer belt 105 to form a full-color image. The driving roller 108 is rotationally driven by, e.g., a driving motor and a driving gear. The driven roller 107 is rotated by the intermediate transfer belt 105 rotated by the driving force of the driving roller 108. The driving roller 108, a driving motor that drives the driving roller 108, and the driven roller 107 that rotates according to the driving of the driving roller 108 function as a driving device or driving means that rotates the intermediate transfer belt 105.

A transfer roller 119 is disposed at a position opposite the driving roller 108 across the intermediate transfer belt 105. The transfer roller 119 constitutes a secondary transfer device that applies pressure to press a sheet 104, that is a recording medium, against the intermediate transfer belt 105. The sheet 104 supplied from a sheet feed tray 101 is pressed against the intermediate transfer belt 105 by the pressure from the transfer roller 119 and conveyed, and the color image formed on the intermediate transfer belt 105 is transferred to the sheet 104.

The yellow image forming unit 106Y includes, for example, a photoconductive drum 109Y serving as an image bearer, a charging roller 110Y serving as a charging roller disposed around the photoconductive drum 109Y, an optical writing control device 111, a developing device 112Y, a photoconductive drum cleaner, and a static eliminator 113Y. The optical writing control device 111 irradiates the photoconductive drums 109Y, 109M, 109C, and 109K, which may be hereinafter collectively referred to as "photoconductive drums 109", corresponding to the respective colors with light.

Upon image formation, the outer peripheral surface of the photoconductive drum 109Y is uniformly charged by the charging roller 110Y in the dark, and writing is performed by light from a light source corresponding to a yellow image from the optical writing control device 111. Thus, an electrostatic latent image are formed on the photoconductive drum 109Y. The developing device 112Y develops the electrostatic latent images into a visible image with yellow toner. Thus, a yellow toner image is formed on the photoconductive drum 109Y.

The toner image is transferred to the intermediate transfer belt 105 by the action of the transfer device 115Y at a position (transfer position) at which the photoconductive drum 109Y and the intermediate transfer belt 105 are in contact with or closest to each other. Accordingly, the yellow toner image is transferred onto the intermediate transfer belt 105. After the transfer of the toner image is completed, unnecessary toner remaining on the outer peripheral surface of the photoconductive drum 109Y is wiped off by the photoconductive drum cleaner, and then the photoconductive drum 109Y is destaticized by the static eliminator 113Y to wait for the next image formation.

As described above, the yellow toner image is transferred onto the intermediate transfer belt 105 by the yellow image forming unit 106Y and conveyed to the next magenta image forming unit 106M by the roller drive of the intermediate transfer belt 105. This conveyance direction is the sub-scanning direction. The width direction (depth direction in FIG. 1) of the intermediate transfer belt 105 orthogonal to the sub-scanning direction is the main scanning direction. In the magenta image forming unit 106M, a magenta toner image is formed on the photoconductive drum 109M by the same process as the image forming process in the yellow image forming unit 106Y. The magenta toner image is transferred so as to be superimposed on the yellow toner image that has already been formed and transferred.

The toner images, in which the yellow toner image and the magenta toner image are transferred to the intermediate transfer belt 105 and superimposed one on another, are further conveyed to the cyan image forming unit 106C and the black image forming unit 106K. According to similar operations, the cyan toner image formed on the photoconductive drum 109C and the black toner image formed on the photoconductive drum 109K are superimposed on the already transferred toner images (in other words, the toner images in which yellow and magenta are superimposed). Thus, a color intermediate transfer image is formed on the intermediate transfer belt 105.

The sheets 104 stored in the sheet feed tray 101 are fed in order from the uppermost sheet, stopped once by a registration roller pair 103, and fed to a transfer position of the intermediate transfer image from the intermediate transfer belt 105 according to the timing of image formation in the image forming units 106. The intermediate transfer image formed on the intermediate transfer belt 105 is transferred to the sheet 104 at a position where the conveyance path is in contact with or closest to the intermediate transfer belt 105, thus forming a color image. The sheet 104 on which the image is formed is further conveyed, and after the image is fixed by the fixing device 116, the sheet is ejected to the outside of the MFP 100.

In the MFP 100 having the above-described configuration, the toner images of the respective colors, which are to be originally overlapped, do not overlap one on top of another, and positional deviation (color-registration-deviation) may occur between the respective colors due to, for example, an error in the distances between the axes of the photoconductive drums 109Y, 109M, 109C, and 109K, an error in the parallelism of the photoconductive drums 109Y, 109M, 109C, and 109K, an error in the installation of light emitting diode arrays (LEDA) 130 in the optical writing control device 111, and an error in the timing of writing electrostatic latent images on the photoconductive drums 109Y, 109M, 109C, and 109K. Accordingly, due to the influence of the fluctuation in the rotation speed of the endless rotating member in the MFP 100, the positional deviation of the superimposed position of the toner images may occur, and the color-registration deviation of the image formed on the recording medium may occur.

The MFP 100 includes pattern detection sensors 117 to detect a correction pattern 500 formed for correcting positional deviation. The pattern detection sensors 117 are, for example, optical sensors (TM sensors) using reflection of light. The pattern detection sensors 117 are sensors that read the correction pattern 500 transferred as a toner image onto the intermediate transfer belt 105 by the photoconductive drums 109Y, 109M, 109C, and 109K. Each of the pattern detection sensors 117 includes a light emitting element and a light receiving element. The light emitting element emits light to illuminate the correction pattern 500 drawn on the surface of the intermediate transfer belt 105. The light receiving element receives reflected light from the correction pattern 500. As illustrated in FIG. 1, the pattern detection sensors 117 are disposed downstream from the photoconductive drums 109Y, 109M, 109C, and 109K in the conveyance direction of the sheet 104. The plurality of pattern detection sensors 117 are supported on the same board along a direction (so-called main scanning direction) orthogonal to the conveyance direction in which the sheet 104 is conveyed by the intermediate transfer belt 105.

When the light emitted from the light emitting element is reflected by the surface of the intermediate transfer belt 105, the light is received by the light receiving element and output as an output voltage in the pattern detection sensor 117. The output voltage is higher than an output voltage based on the light reflected by the correction pattern 500. Detecting the output voltages of the pattern detection sensors 117 allows detection of the formation position of the correction pattern 500 formed on the intermediate transfer belt 105. On the other hand, the formation position of the correction pattern 500 on the intermediate transfer belt 105 can be specified based on the formation timing of the toner image in the optical writing control device 111. Accordingly, comparing the detection result of the correction pattern 500 by the pattern detection sensors 117 with the formation position of the correction pattern 500 with respect to the intermediate transfer belt 105 allows the "positional deviation amount" to be calculated when the toner image of each color (each color image) is deviated from the ideal position. Based on the positional deviation amount, a correction value for correcting an operation of forming each color image in the optical writing control device 111 can be calculated in order to restrain the positional deviation. The correction operation of calculating a correction value and performing correction is performed at a predetermined timing. Details of the pattern detection sensors 117 and an aspect of positional-deviation correction are described later. Note that the MFP 100 includes a configuration for achieving information processing function such as a central processing unit (CPU) 10 described later, and operates under the control of such a configuration.

The MFP 100 includes a belt cleaner 118 to remove the toner of the correction pattern 500 drawn by the toner image transferred to the intermediate transfer belt 105 so that the sheet 104 conveyed by the intermediate transfer belt 105 is not contaminated with the toner. As illustrated in FIG. 1, the belt cleaner 118 is disposed downstream from the driving roller 108 and upstream from the photoconductive drums 109 in the conveyance direction of the sheet. The belt cleaner 118 is a cleaning blade pressed against the intermediate transfer belt 105. The belt cleaner 118 is a developer remover that scrapes off the toner adhering to the surface of the intermediate transfer belt 105.

Outline of Optical Writing Device

Figure 2:
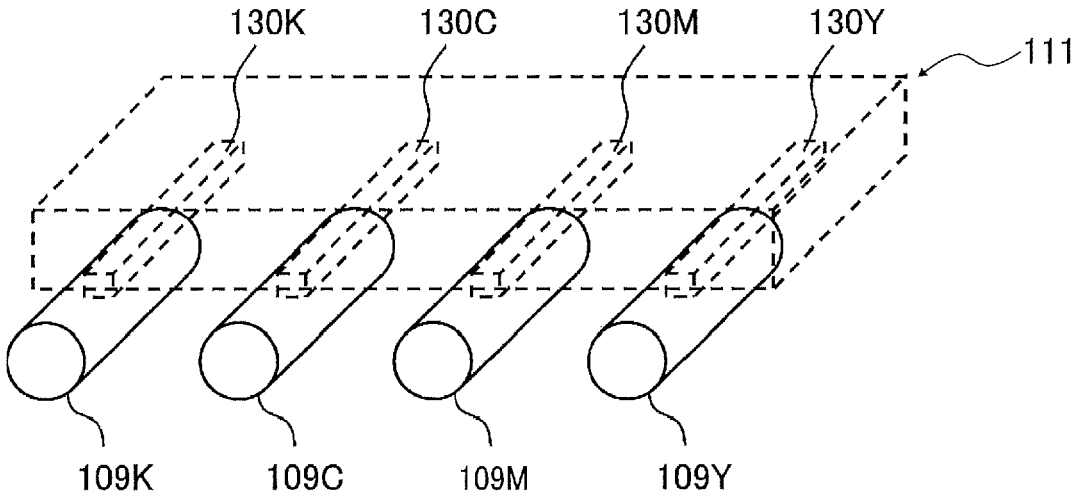
FIG. 2 is a schematic diagram illustrating a configuration of an optical writing control device included in the MFP of FIG. 1.

The optical writing control device 111 mounted on the MFP 100 according to the present embodiment is described below. FIG. 2 is a diagram illustrating the relative positions between the optical writing control device 111 and the photoconductive drums 109 according to the present embodiment. As illustrated in FIG. 2, the irradiation light irradiated to each of the photoconductive drums 109Y, 109M, 109C, and 109K of the respective colors is irradiated from each of the LEDA 130Y, 130M, 130C, and 130K (hereinafter, collectively referred to as LEDA 130) as light sources. In the optical writing control device 111 according to the present embodiment, a laser diode (LD) may be used as the light source. Accordingly, the type of the configuration used as the light source is not limited as long as the light source can cope with the optical writing control according to the present embodiment. In the LEDA 130, light emitting diodes (LEDs) as light emitting elements are arranged in the main scanning direction of each of the photoconductive drums 109. The controller included in the optical writing control device 111 controls the on/off state of each of the LEDs arranged in the main scanning direction for each main scanning line based on drawing data input from a controller 20 described later. Thus, the controller in the optical writing control device 111 selectively exposed the surfaces of the photoconductive drums 109 to form electrostatic latent images.

Hardware Configuration of Image Forming Apparatus

Figure 3:
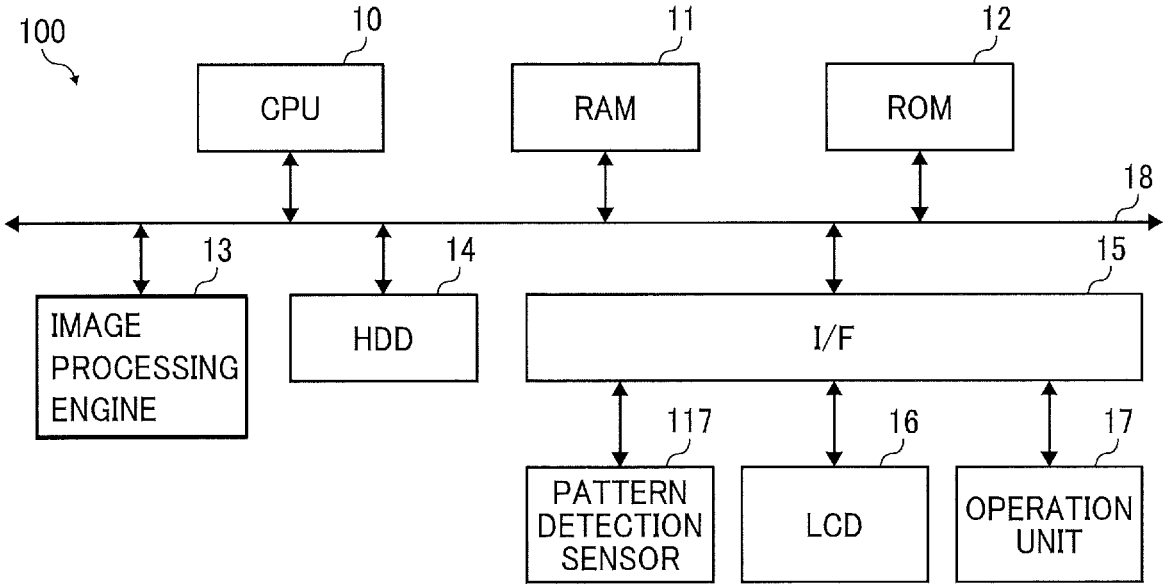
FIG. 3 is a hardware block diagram of a control system included in the MFP of FIG. 1.

A hardware configuration constituting a control system of an image forming apparatus including an optical writing device according to an embodiment of the present disclosure is described below with reference to FIG. 3. The control system of the MFP 100 according to the present embodiment includes an image processing engine 13 that executes image formation in addition to a configuration similar to the configuration of a personal computer (PC) that is an information processing apparatus. For example, the MFP 100 according to the present embodiment includes a CPU 10, a random access memory (RAM) 11, a read only memory (ROM) 12, an image processing engine 13, a hard disk drive (HDD) 14, and an interface (I/F) 15 that are connected via a system bus 18. A liquid crystal display (LCD) 16, an operation unit 17, and a pattern detection sensor 117 are connected to the I/F 15.

The CPU 10 is control means or processing circuitry and controls the operation of the entire MFP 100. The RAM 11 is a volatile storage medium that allows reading and writing of data at a high speed and is used as a working area when the CPU 10 processes data. The ROM 12 is a non-volatile read only storage medium and stores programs such as firmware. The image processing engine 13 includes components that operate to actually perform image formation in the MFP 100.

The HDD 14 is a nonvolatile storage medium that allows reading and writing of data, and stores, for example, an operating system (OS), various control programs, and application programs. The I/F 15 connects the system bus 18 to various hardware components or networks for control. The LCD 16 is a visual user interface for a user to confirm the state of the MFP 100. The operation unit 17 is a user interface such as a keyboard or a mouse used by the user to input information to the MFP 100.

In such a hardware configuration, the CPU 10 reads out a program stored in a recording medium such as the ROM 12 or the HDD 14 to the RAM 11 and performs an operation according to the program, thus configuring a software controller. A combination of the software controller configured as described above and hardware constitutes functional blocks that implement the functions of the MFP 100 according to the present embodiment. Note that the hardware configuration illustrated in FIG. 3 is an example, and the hardware configuration of the MFP 100 according to the present embodiment is not limited to the configuration of FIG. 3 as long as the configuration of the hardware is capable of achieving the functional configuration described below.

Functional Configuration of Image Forming Apparatus

Figure 4:
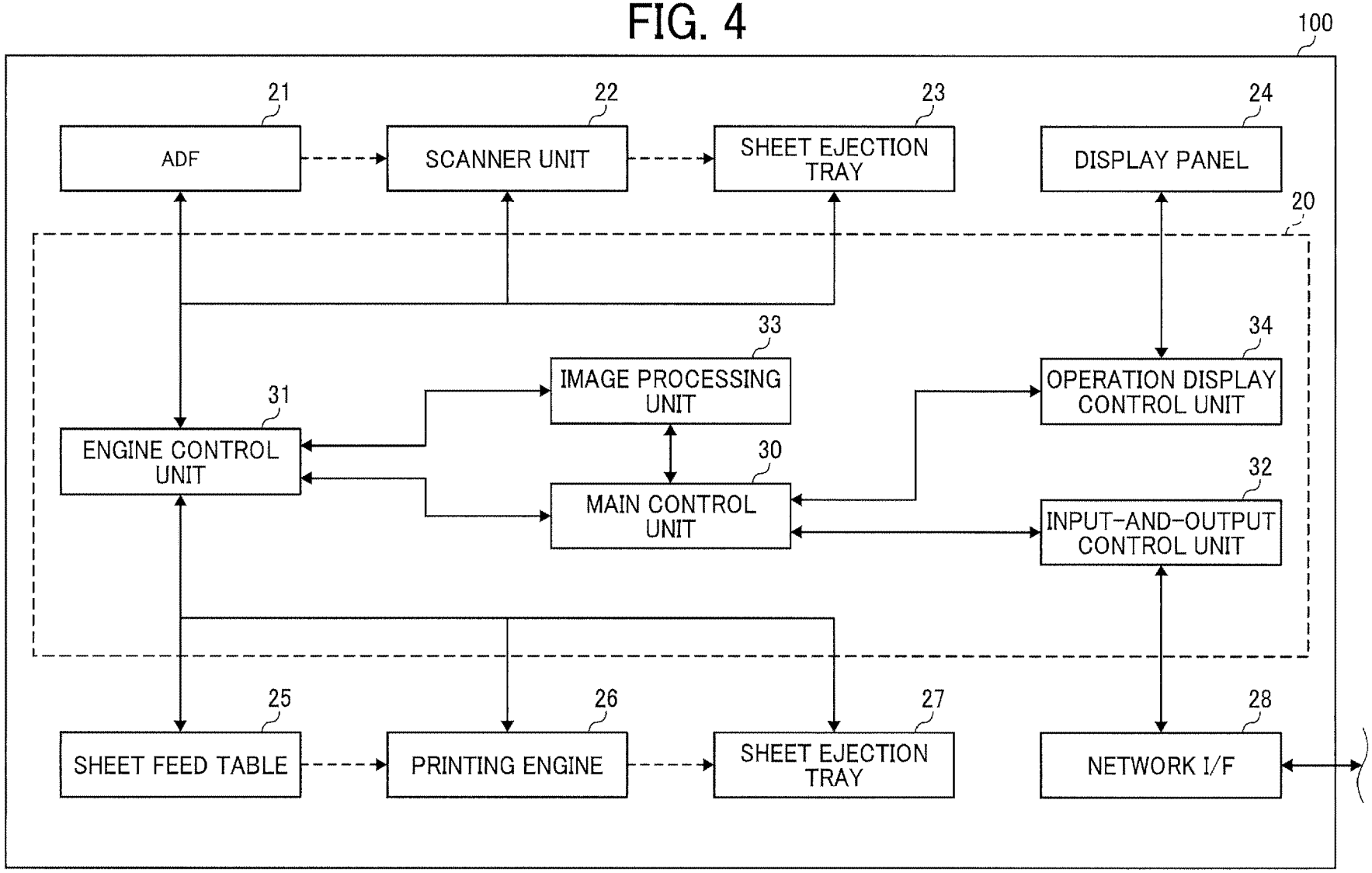
FIG. 4 is a functional block diagram of the MFP of FIG. 1.

The functional configuration of the MFP 100 according to the present embodiment is described with reference to FIG. 4. FIG. 4 is a block diagram illustrating a functional configuration of the MFP 100 according to the present embodiment. The MFP 100 includes a controller 20, an auto document feeder (ADF) 21, a scanner unit 22, a sheet ejection tray 23, a display panel 24, a sheet feed table 25, a printing engine 26, a sheet ejection tray 27, and a network I/F 28.

The controller 20 includes a main control unit 30, an engine control unit 31, an input-and-output control unit 32, an image processing unit 33, and an operation display control unit 34. The MFP 100 according to the present embodiment is a multifunction peripheral including the scanner unit 22 and the printing engine 26. In FIG. 4, electrical connections are indicated by solid arrows, and the flow of a recording medium is indicated by broken arrows.

The display panel 24 is an output interface that visually displays the state of the MFP 100 and is also an input interface (operation unit) used as a touch panel when the user directly operates the MFP 100 or inputs information to the MFP 100. The network I/F 28 is an interface for the MFP 100 to communicate with other devices via a network. For example, an Ethernet (registered trademark) or universal serial bus (USB) interface is used as the network I/F 28.

The controller 20 is configured by a combination of software and hardware. For example, control programs stored in the ROM 12, a non-volatile memory, and the HDD 14 are loaded onto a volatile memory (hereinafter referred to as a memory) such as the RAM 11. The controller 20 is configured by a software controller implemented by computation of the CPU 10 according to the control programs and hardware such as integrated circuits. The controller 20 functions as a controller that controls the entire MFP 100.

The main control unit 30 controls units included in the controller 20 and gives an instruction to each unit of the controller 20. The engine control unit 31 serves as a driver hat controls or drives, for example, the printing engine 26 and the scanner unit 22. The input-and-output control unit 32 inputs signals and commands input via the network I/F 28 to the main control unit 30. The main control unit 30 controls the input-and-output control unit 32 to access other devices via the network I/F 28.

The image processing unit 33 generates drawing data based on print data included in an input print job under the control of the main control unit 30. The drawing data is data for drawing an image to be formed by the printing engine 26 serving as an image forming unit in an image forming operation. The print data included in the print job is image data converted in a format recognizable by the MFP 100. The conversion of the image data is performed by, for example, a printer driver installed in an information processing apparatus such as a PC. The operation display control unit 34 displays information on the display panel 24 or notifies the main control unit 30 of data input via the display panel 24.

When the MFP 100 operates as a printer, the input-and-output control unit 32 receives a print job via the network I/F 28. The input-and-output control unit 32 transfers the received print job to the main control unit 30. Upon receiving the print job, the main control unit 30 causes the image processing unit 33 to generate drawing data according to print data included in the print job.

When the drawing data is generated by the image processing unit 33, the engine control unit 31 controls the printing engine 26 according to the generated drawing data and executes image formation on the recording medium conveyed from a sheet feed table 25. In other words, the printing engine 26 serves as an image forming unit. The recording medium on which an image has been formed by the printing engine 26 is ejected to the sheet ejection tray 27.

The image data generated by the image processing unit 33 is stored in, e.g., the HDD 14 as it is in accordance with an instruction of the user, or is transmitted to an external device via the input-and-output control unit 32 and the network I/F 28. In other words, the ADF 21 and the engine control unit 31 serve as an image input unit.

When the MFP 100 operates as a copier, the image processing unit 33 generates drawing data according to the image data received by the engine control unit 31 from the scanner unit 22 or the image data generated by the image processing unit 33. As in the case of the printer operation, the engine control unit 31 drives the printing engine 26 according to the drawing data.

Figure 5:
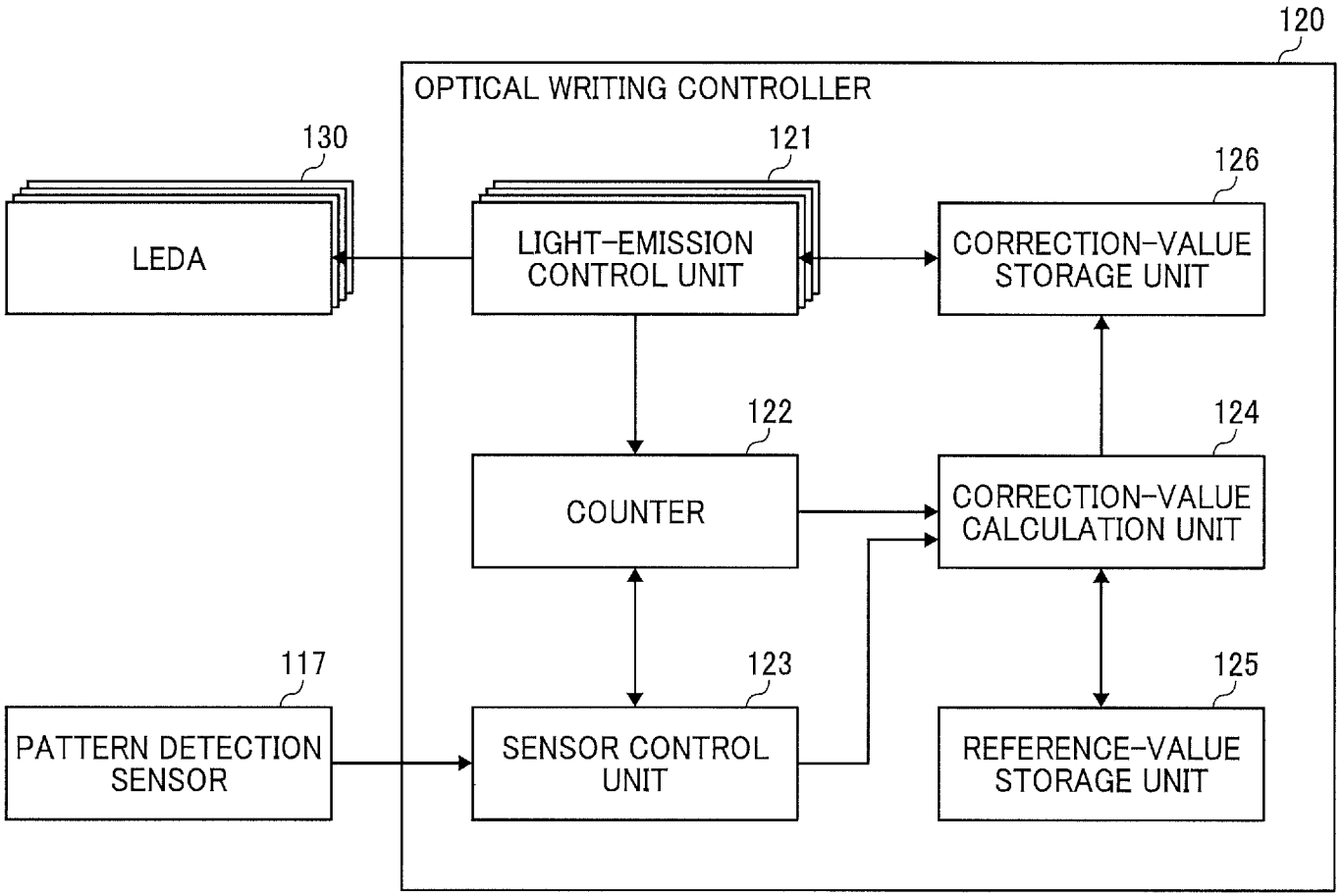
FIG. 5 is a functional block diagram illustrating an embodiment of control blocks of the optical writing control device of FIG. 2.

Control Blocks of Optical Writing Device Control blocks of the optical writing control device 111 according to the present embodiment are described with reference to FIG. 5. FIG. 5 is a diagram illustrating a functional configuration of the optical writing controller 120 that controls the optical writing control device 111 according to the present embodiment and the relations of the optical writing controller 120 with the LEDA 130 and the pattern detection sensor 117.

As illustrated in FIG. 5, the optical writing controller 120 according to the present embodiment includes a light-emission control unit 121, a counter 122, a sensor control unit 123, a correction-value calculation unit 124, a reference-value storage unit 125, and a correction-value storage unit 126. The optical writing controller 120 functions as an optical writing control device that controls LEDAs 130 serving as light sources to form electrostatic latent images on the photoconductive drums.

Similarly to the controller 20 in the MFP 100, the optical writing controller 120 is configured by loading a control program stored in the ROM 12 or the HDD 14 into the RAM 11 and operating according to arithmetic processing in the CPU 10.

The light-emission control unit 121 is a light source control unit that controls the LEDAs 130 according to image data input from the engine control unit 31 of the controller 20. In other words, the light-emission control unit 121 also functions as a pixel data acquisition unit. The light-emission control unit 121 causes the LEDAs 130 to emit light in a certain line cycle to achieve optical writing onto the photoconductive drums 109.

The line cycle at which the light-emission control unit 121 controls the light emission of the LEDAs 130 is determined by the output resolution of the image forming apparatus. However, as described above, in a case where the magnification is changed in the sub-scanning direction according to the ratio to the conveyance speed of a sheet, the light-emission control unit 121 adjusts the line cycle to change the magnification in the sub-scanning direction.

In addition to driving the LEDAs 130 according to the drawing data input from the engine control unit 31, the light-emission control unit 121 controls light emission of the LEDAs 130 to draw the correction pattern 500 in the above-described drawing parameter correction processing.

As described in FIG. 2, the plurality of LEDAs 130 are provided corresponding to the respective colors. Accordingly, as illustrated in FIG. 5, a plurality of light-emission control units 121 are provided so as to correspond to the respective LEDAs 130. In the drawing parameter correction processing, the correction value generated as a result of the positional-deviation correction processing as the positional-deviation correction operation is stored as a color positional-deviation correction value in the correction-value storage unit 126 illustrated in FIG. 5.

The light-emission control unit 121 corrects the timing of driving the LEDAs 130 according to the past color-registration-deviation correction values stored in the correction-value storage unit 126. To correct the position of an image in the main scanning direction, when the light-emission control unit 121 causes the LEDA 130 to emit light based on the image data for each main scanning line, the light-emission control unit 121 adjusts the correspondence between each pixel data constituting the image data for one line and each LED element included in the LEDA 130 based on the color-registration-deviation correction values stored in the correction-value storage unit 126.

The correction of the driving timing of the LEDA 130 by the light-emission control unit 121 is implemented by delaying the timing of the light emission driving of the LEDA 130 in the unit of line cycle based on the drawing data input from the engine control unit 31, in other words, by shifting the line. On the other hand, since the drawing data is sequentially input from the engine control unit 31 in accordance with a predetermined cycle, the input drawing data are held and the reading timing is delayed to shift the line and delay the light emission timing Accordingly, the light-emission control unit 121 has a line memory that is a storage medium to hold the drawing data input for each main scanning line. The light-emission control unit 121 stores the drawing data in the line memory to hold the drawing data input from the engine control unit 31. As the correction of the drive timing of the LEDA 130, fine adjustment of the light emission timing for each line cycle is performed in addition to the adjustment for each line cycle. The light-emission control unit 121 constitutes a pattern forming unit or pattern forming means.

In the color-registration-deviation correction processing, the counter 122 starts counting at the same time when the light-emission control unit 121 controls the LEDA 130 to start exposure of the photoconductive drum 109K. The counter 122 acquires a detection signal output when the sensor control unit 123 detects the correction pattern 500 based on the output signal of the pattern detection sensor 117. In other words, the counter 122 executes interrupt control based on the operation clock of the CPU 10 and acquires a detection signal (output voltage of the pattern detection sensor 117) from the sensor control unit 123. The counter 122 inputs the count value at the timing when the correction-value calculation unit 124 acquires the detection signal. In other words, the counter 122 functions as a detection timing acquisition unit that acquires the detection timing of the correction pattern 500.

The sensor control unit 123 is a control unit that controls the pattern detection sensors 117. As described above, based on the output signal of the pattern detection sensor 117, the sensor control unit 123 determines that the positional-deviation correction pattern formed on the intermediate transfer belt 105 has reached the positions of the pattern detection sensors 117, and outputs a detection signal. In other words, the sensor control unit 123 as a pattern detection unit or pattern detection means also functions as a detection signal acquisition unit that acquires pattern detection signals from the pattern detection sensors 117.

In the density correction using the density correction pattern, the sensor control unit 123 acquires the signal intensities of the output signals of the pattern detection sensors 117 and inputs the signal intensities to the correction-value calculation unit 124. The sensor control unit 123 adjusts the detection timing of the density correction pattern according to the detection result of the correction pattern 500. The sensor control unit 123 constitutes a combination pattern detection unit or combination pattern detection means.

The correction-value calculation unit 124 calculates a correction value based on the reference value for positional-deviation correction and the reference value for density correction stored in the reference-value storage unit 125, according to the count value acquired from the counter 122 and the signal intensities of the detection result of the density correction pattern acquired from the sensor control unit 123. In other words, the correction-value calculation unit 124 functions as a reference-value acquisition unit and a correction-value calculation unit. The reference-value storage unit 125 stores a reference value used for such calculation. The correction value is calculated based on the "deviation direction" and the "deviation amount" of the positional-deviation correction pattern. The correction-value calculation unit 124 constitutes a correction value calculator or correction-value calculation means.

Brief Description of Periodic Speed Variation

A description is given below of an example of a cause of occurrence of a periodic rotational speed fluctuation due to an endless component, that is a problem to be solved, in an image forming apparatus according to an embodiment of the present disclosure. In FIG. 6, the intermediate transfer belt 105 is illustrated as an endless component (endless rotating body). However, the cause of the rotational speed fluctuation to be a problem is not limited to the intermediate transfer belt 105. For example, in other components such as the photoconductive drums 109, the rotational speed fluctuation is also a cause of the periodic speed fluctuation of the rotating body.

Figure 6A:
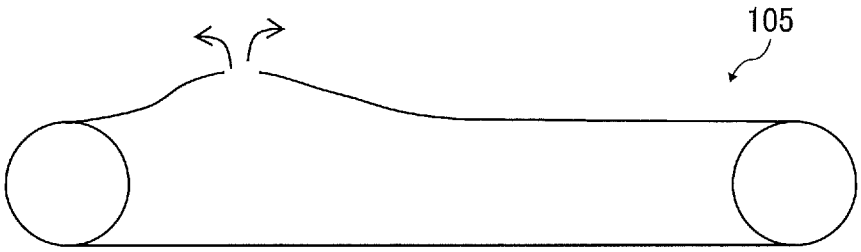
FIG. 6A is a diagram illustrating an intermediate transfer belt.
Figure 6B:
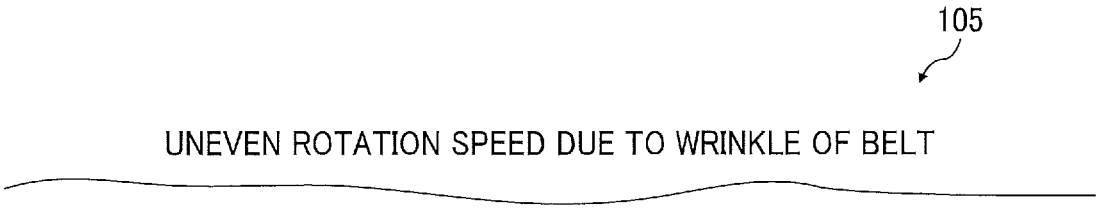
FIG. 6B is a diagram illustrating an example of fluctuation of the intermediate transfer belt of FIG. 6A.

As illustrated in FIG. 6A, for example, assume that a part of the intermediate transfer belt 105 is cut and extended. Since the intermediate transfer belt 105 is made of a resin material (e.g., thermoplastic elastomers (TPE)), as illustrated in FIG. 6B, the surface of the intermediate transfer belt 105 is "twisted" or "curled", and the intermediate transfer belt 105 is not flat over the entire length thereof. Accordingly, even when the intermediate transfer belt 105 is simply rotated as an endless rotating body, a uniform rotational speed is not obtained. If each color image is transferred to the surface of the intermediate transfer belt 105 whose rotation speed is not uniform, the intermediate transfer belt 105 returns to the same position as the transfer position before one rotation, when the intermediate transfer belt 105 makes one rotation. However, a positional deviation occurs at any local position while the intermediate transfer belt 105 makes one rotation. At such a local position, the current transfer position is different from the transfer position before one rotation. In other words, during one rotation of the intermediate transfer belt 105, a "periodical positional deviation" locally occurs in which the current transfer position is different from the transfer position in the previous rotation.

Figure 7:
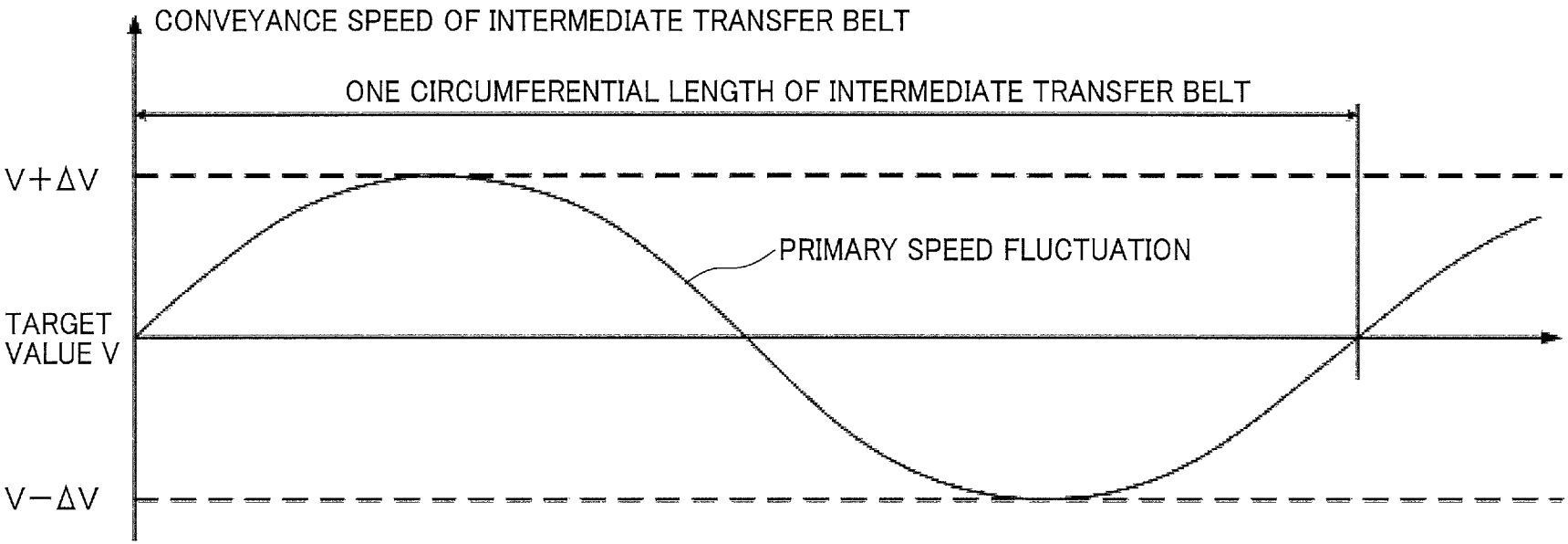
FIG. 7 is a graph illustrating fluctuation of an intermediate transfer belt.

FIG. 7 is a graph illustrating the fluctuation of the rotation speed of the intermediate transfer belt 105 (the conveyance speed of the toner image) over the entire circumference of the intermediate transfer belt 105. The origin of the graph of FIG. 7 is assumed to be an ideal rotation speed (target value V). To make the description easy to understand, the rotation speed of the intermediate transfer belt 105 varies so as to draw a sine curve with one cycle being the circumferential length of the intermediate transfer belt 105. Since the intermediate transfer belt 105 continues to rotate in the image forming process, similar speed fluctuations occur repeatedly. Hereinafter, when referring to the fluctuation of the rotation speed, in particular, the fluctuation of the rotation speed around the intermediate transfer belt 105 by one circumference is referred to as "primary speed fluctuation".

The following description focuses on the intermediate transfer belt 105 among the components (endless rotating bodies) that cause periodic speed fluctuations. Note that the intermediate transfer belt 105 may be replaced with another endless rotating member that is a power transmitter or power transmission means such as the photoconductive drum 109, the transfer roller 119, the driving roller 108, the driven roller 107, the charging roller, or a driving gear thereof.

First Comparative Example for Correction Pattern 500

Figure 8:
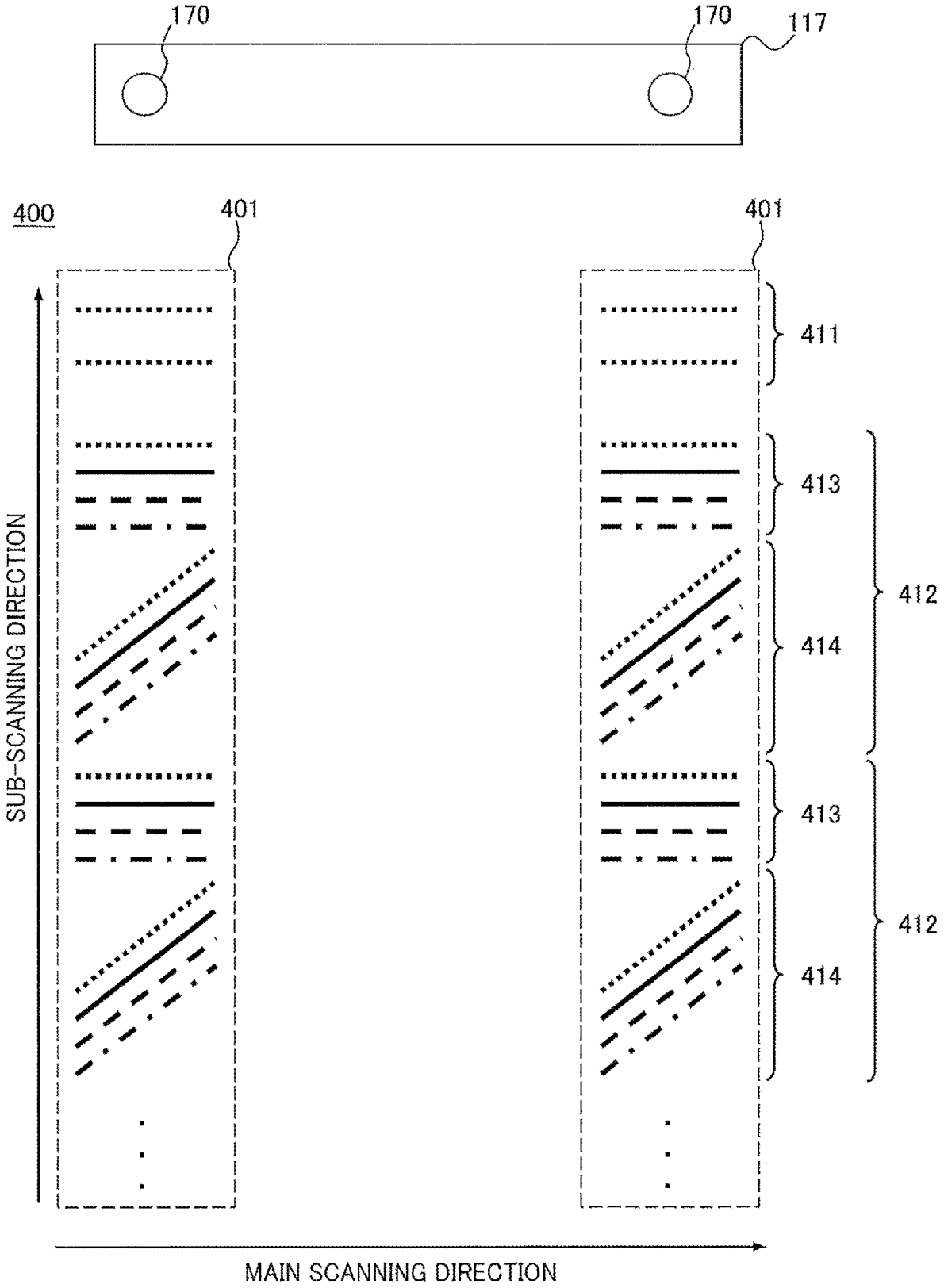
FIG. 8 RELATED ART
FIG. 8 is a diagram illustrating a correction pattern in a first comparative example with respect to a correction pattern of a transfer position deviation in the MFP of FIG. 1.

Here, a description is given of one of comparative examples for the correction pattern 500 before describing the outline of the positional-deviation correction operation according to the present embodiment. This example is a first comparative example. FIG. 8 illustrates a comparative pattern 400 as a comparative example of detection pattern. Since the structure for detecting the pattern is also similar for the correction pattern 500 according to the present embodiment, the pattern detection operation is exemplified while describing the first comparative example. The comparative pattern 400 is a pattern image drawn on the intermediate transfer belt 105 by the LEDAs 130 controlled by the light-emission control unit 121. For example, various pattern images are arranged in the sub-scanning direction to form an alignment pattern array 401. In addition, a plurality of alignment pattern arrays 401 are arranged in the main scanning direction.

The comparative pattern 400 is constituted by line patterns corresponding to the respective colors. In the present specification, in expressing the difference in color between the line patterns, the dotted line indicates an image drawn by the photoconductive drum 109Y. A solid line indicates an image drawn by the photoconductive drum 109K. A broken line indicates an image drawn by the photoconductive drum 109C. An alternate long and short dash line indicates an image drawn by the photoconductive drum 109M. In other words, the dotted line indicates "yellow", the solid line indicates "black", the broken line indicates "cyan", and the alternate long and short dash line indicates "magenta".

The alignment pattern array 401 is drawn at a position passing through the detection range of each pattern detection sensor element 170. When the line images constituting the alignment pattern array 401 enters the detection range of the pattern detection sensor element 170, the output voltage of the pattern detection sensor element 170 drops. When the line pattern passes through the detection range, the output voltage of the pattern detection sensor element 170 rises. Based on the output voltage, the sensor control unit 123 acquires a detection signal output by detecting the positional-deviation correction pattern, and inputs a count value at the timing when the counter 122 acquires the detection signal, to the correction-value calculation unit 124.

Thus, the optical writing controller 120 can detect the image constituting the detection pattern at a plurality of positions in the main scanning direction, and can correct the skew of the drawn image. Averaging the detection results based on the plurality of pattern detection sensor elements 170 allows the correction accuracy to be enhanced.

As illustrated in FIG. 8, the alignment pattern array 401 includes an entire-position correction pattern 411 and a drum-interval correction pattern 412. As illustrated in FIG. 8, the drum-interval correction pattern 412 is repeatedly drawn.

As illustrated in FIG. 8, the entire-position correction pattern 411 includes lines drawn by the photoconductive drum 109Y and parallel to the main scanning direction. The entire-position correction pattern 411 includes a pattern drawn to obtain a count value for correcting the deviation of the entire image in the sub-scanning direction, in other words, the transfer position of the image to the sheet. The entire-position correction pattern 411 is also used for correcting detection timing when the sensor control unit 123 detects the drum-interval correction pattern 412 or a density correction pattern to be described later.

In the entire-position correction using the entire-position correction pattern 411, the optical writing controller 120 performs the correction operation of the writing start timing based on the read signal of the entire-position correction pattern 411 by the pattern detection sensor 117.

The drum-interval correction pattern 412 is a pattern that is drawn to obtain a count value for correcting a deviation in drawing timing on the photoconductive drums 109 of the respective colors, in other words, a superimposed position at which images of the respective colors are superimposed. As illustrated in FIG. 8, the drum-interval correction pattern 412 includes a horizontal line pattern 413 and a diagonal line pattern 414. As illustrated in FIG. 8, in the drum-interval correction pattern 412, horizontal line patterns 413 of the respective colors constituted by a set of four linear images in a direction orthogonal to the conveyance direction and diagonal line patterns 414 of the respective colors constituted by a set of four linear patterns inclined at a predetermined angle with respect to the conveyance direction are alternately repeated. A total of eight linear images of the four horizontal line patterns 413 and the four diagonal line patterns 414 are used as a set for calculating the correction value.

The optical writing controller 120 corrects the positional deviation in the sub-scanning direction of the writing start position with respect to each of the photoconductive drums 109Y, 109K, 109M, and 109C, based on the read signals of the horizontal line patterns 413 by the pattern detection sensors 117. On the other hand, in the positional-deviation correction operation, the optical writing controller 120 corrects the positional deviation in the main scanning direction of the writing start position with respect to each of the photoconductive drums 109Y, 109K, 109M, and 109C based on the read signals of the diagonal line patterns 414. The process of calculating the correction value for detecting the horizontal line images and correcting the deviation (registration deviation) of the writing start position in the sub-scanning direction and the process of calculating the correction value for detecting the diagonal line images and correcting the deviation (registration deviation) of the writing start position in the main scanning direction are also common to the present embodiment.

Second Comparative Example of Correction Pattern 500

Figure 9:
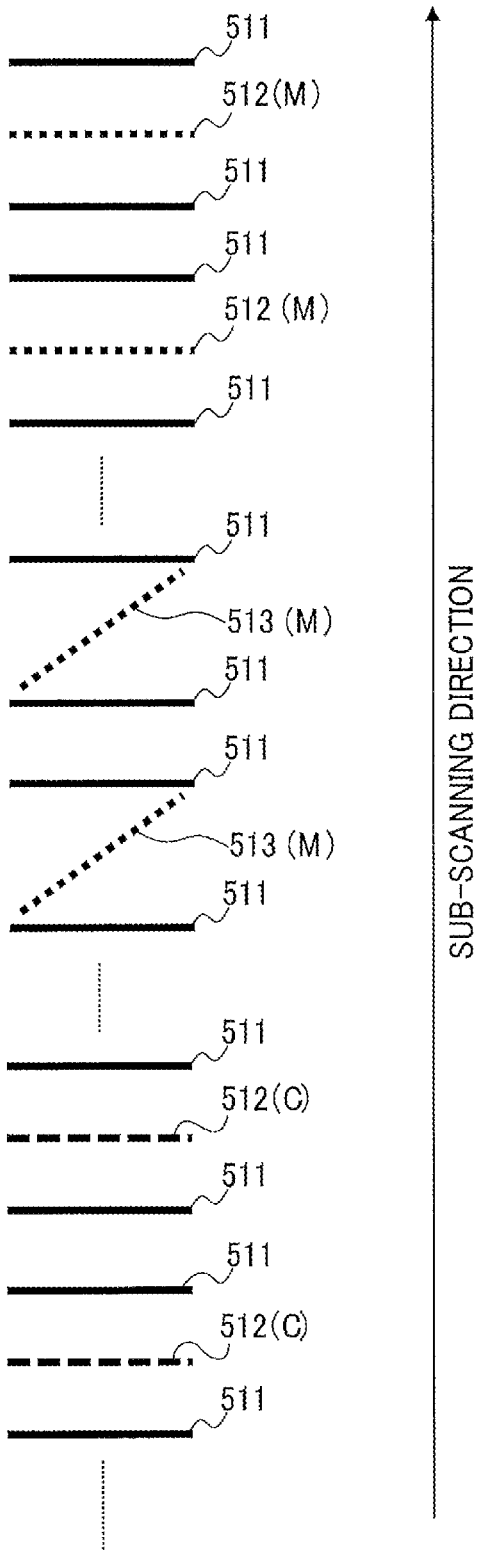
FIG. 9 RELATED ART
FIG. 9 is a diagram illustrating a correction pattern in a second comparative example with respect to the correction pattern of the transfer position deviation in the MFP of FIG. 1.
Figure 10:
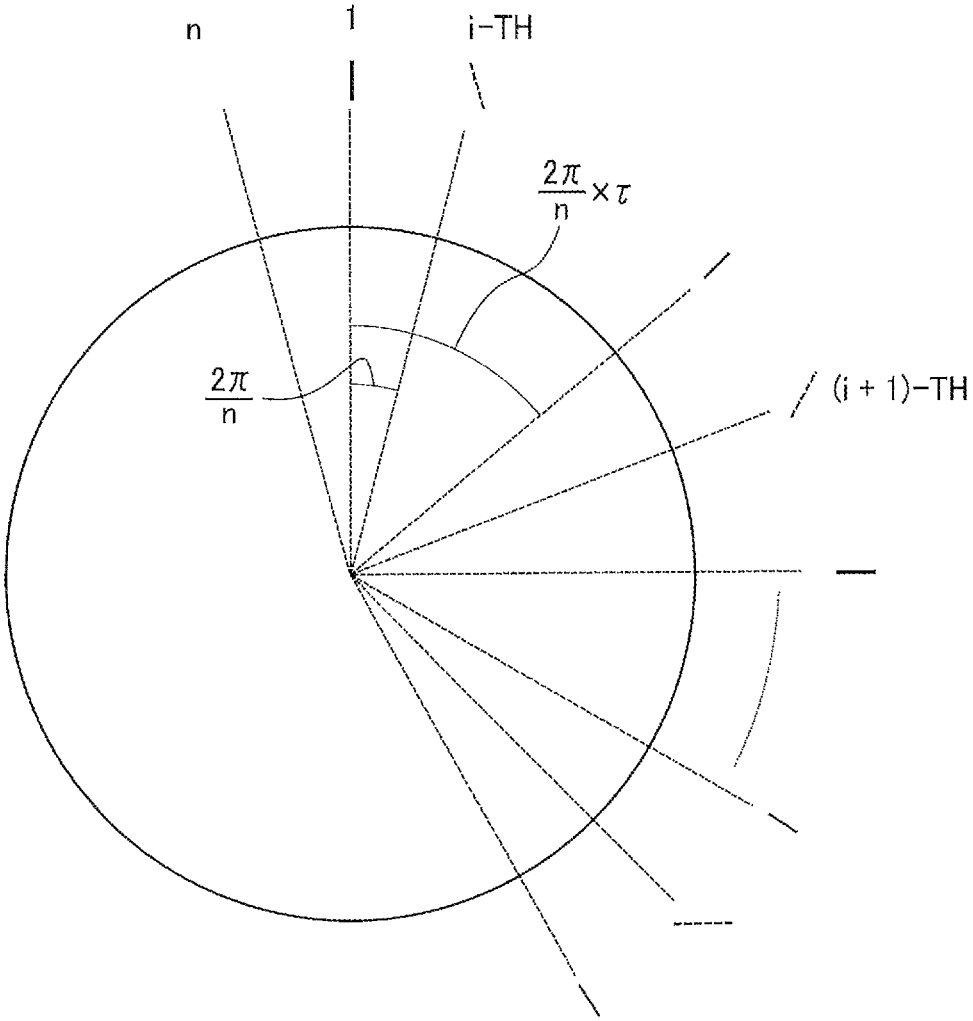
FIG. 10 RELATED ART
FIG. 10 is a diagram illustrating a correction pattern in the second comparative example that is formed at formation positions corresponding to positions obtained by dividing, by n, the circumferential length of an endless rotating body that causes periodic speed fluctuations.
Figure 11:
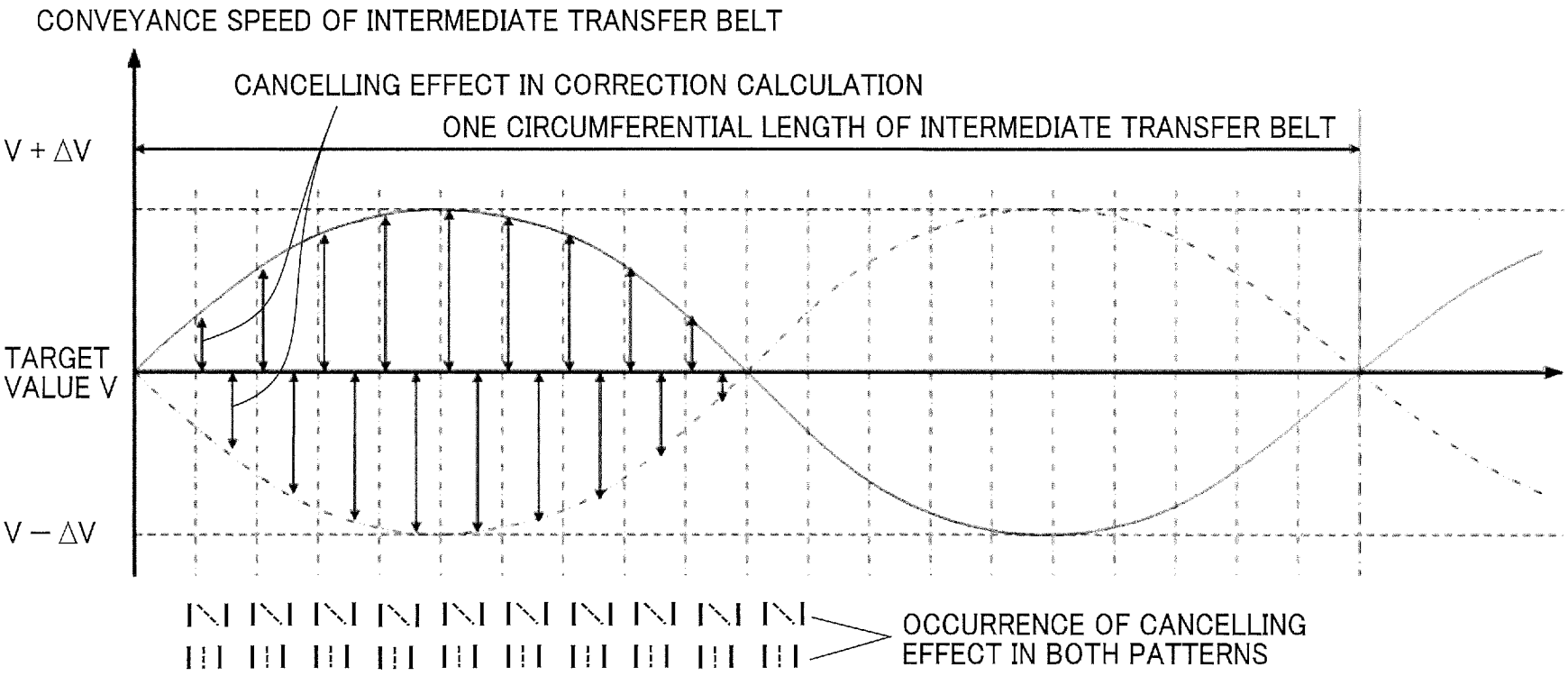
FIG. 11 is a diagram illustrating a relation between periodic speed fluctuation and formation position of correction pattern in the second comparative example.

A description is given below of another comparative example with respect to the correction pattern 500 according to the present embodiment. The second comparative example is an example of one that has already been studied and filed by the applicant of the present application. In the second comparative example, the positional deviation is corrected by using the first combination pattern 521 and the second combination pattern 522 as detection patterns. FIGS. 9 and 10 are diagrams illustrating a method of forming detection patterns according to the second comparative example. FIG. 11 is a diagram illustrating detection patterns according to the second comparative example and an effect of canceling out the influence of the speed fluctuation by the detection patterns.

In the second comparative example, when one period of the speed fluctuation is divided by n, the interval until the same reference line is formed again is set to $\tau$ times, and the magnification parameter $\tau$ is used for the interval of the line pattern repeatedly formed.

As illustrated in FIG. 11, any of the variation of the formation position of the "Z pattern" and the "three-parallel-line pattern" and the periodic speed fluctuation in the second comparative example can also be expressed by a sine function with respect to the deviation of the formation positions of the detection patterns. The intensity component and the phase component are parameters of each order and are expressed as the total sum of the periodic deviations of the formation positions up to the first order, the second order, the third order, . . . , and the infinite order.

In the second comparative example, when attention is paid to a certain set of detection patterns, a "first calculation formula" can be considered in which a positional-deviation correction value is calculated using a reference line (similar to the reference pattern 511) of a detection pattern formed before the set of detection patterns and a line (horizontal line or diagonal line) of a correction target color. In addition, a "second calculation formula" can be considered for calculating a positional-deviation correction value using a reference line (similar to the reference pattern 511) of a detection pattern formed after the set of detection patterns of interest and a line (horizontal line or diagonal line) of the correction target color. Averaging the positional-deviation correction values calculated by the above-described two calculation formulas, a final positional-deviation correction value can be calculated. Performing the above-described calculation processes can "approximately" cancel the periodic deviation of the formation position occurring in one Z pattern (or three-parallel-line pattern). Accordingly, the positional deviation can be corrected without forming line patterns (corresponding to the correction pattern 500) over the entire circumference of the intermediate transfer belt 105.

Here, a description is given of the difference between the first comparative example and the second comparative example. The comparative second example is different from the first comparative example in that the effect is exhibited even if respective line patterns are not formed at the positions obtained by "dividing by an integer" the circumferential length of the intermediate transfer belt 105. In other words, the effect can be exhibited even when respective line patterns are formed at the positions obtained by "dividing by a real number" the circumferential length of the intermediate transfer belt 105. Accordingly, even if periodic deviations in the formation position occur at the same time due to a plurality of endless rotating bodies such as the photoconductive drum 109 and the transfer roller 119, the second comparative example can effectively restrain the influence of the periodic deviations in the formation position in each line pattern when calculating the positional-deviation correction value.

Figure 12:
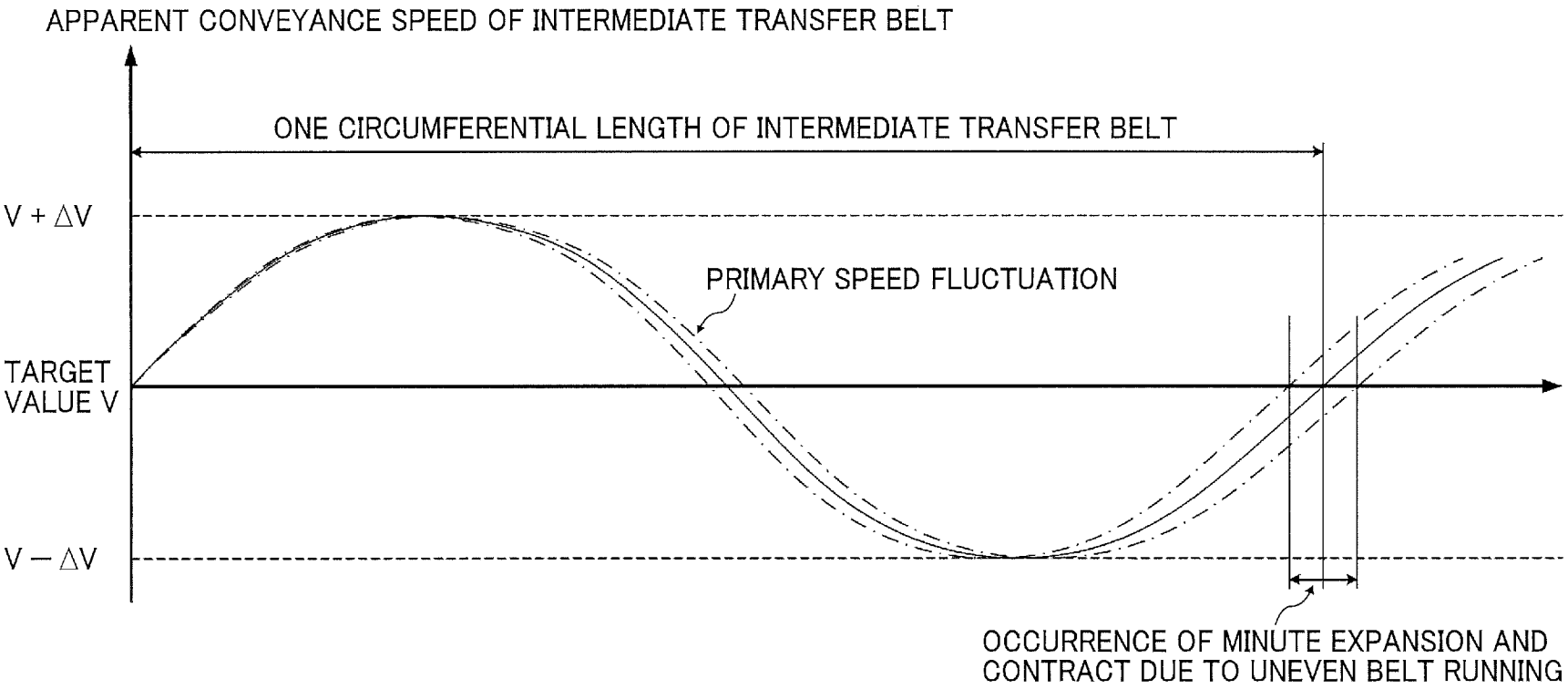
FIG. 12 is a graph illustrating speed fluctuation of an intermediate transfer belt related to a problem to be solved by an embodiment of the present disclosure.

In the first comparative example and the second comparative example described above, it is assumed that the speed fluctuation of the intermediate transfer belt 105 occurs in the same manner in a constant cycle. However, in the case of an endless rotating body such as the intermediate transfer belt 105, in particular, in the case of a structure to which tension is applied when the endless rotating body rotates, the endless rotating body may expand and contract during the rotation. As illustrated in FIG. 12, the speed fluctuation occurring in a constant cycle may be irregular. For example, a driving gear for drive transmission is easily affected by minute speed fluctuations, and a speed fluctuation exceeding an assumed range may occur. If the influence of such an irregular speed fluctuation is not restrained, in particular, the positional alignment accuracy at the time of superimposing a plurality of color images is greatly affected. Accordingly, the correction accuracy of the writing start position deviation (registration deviation) may be deteriorated.

Figure 13:
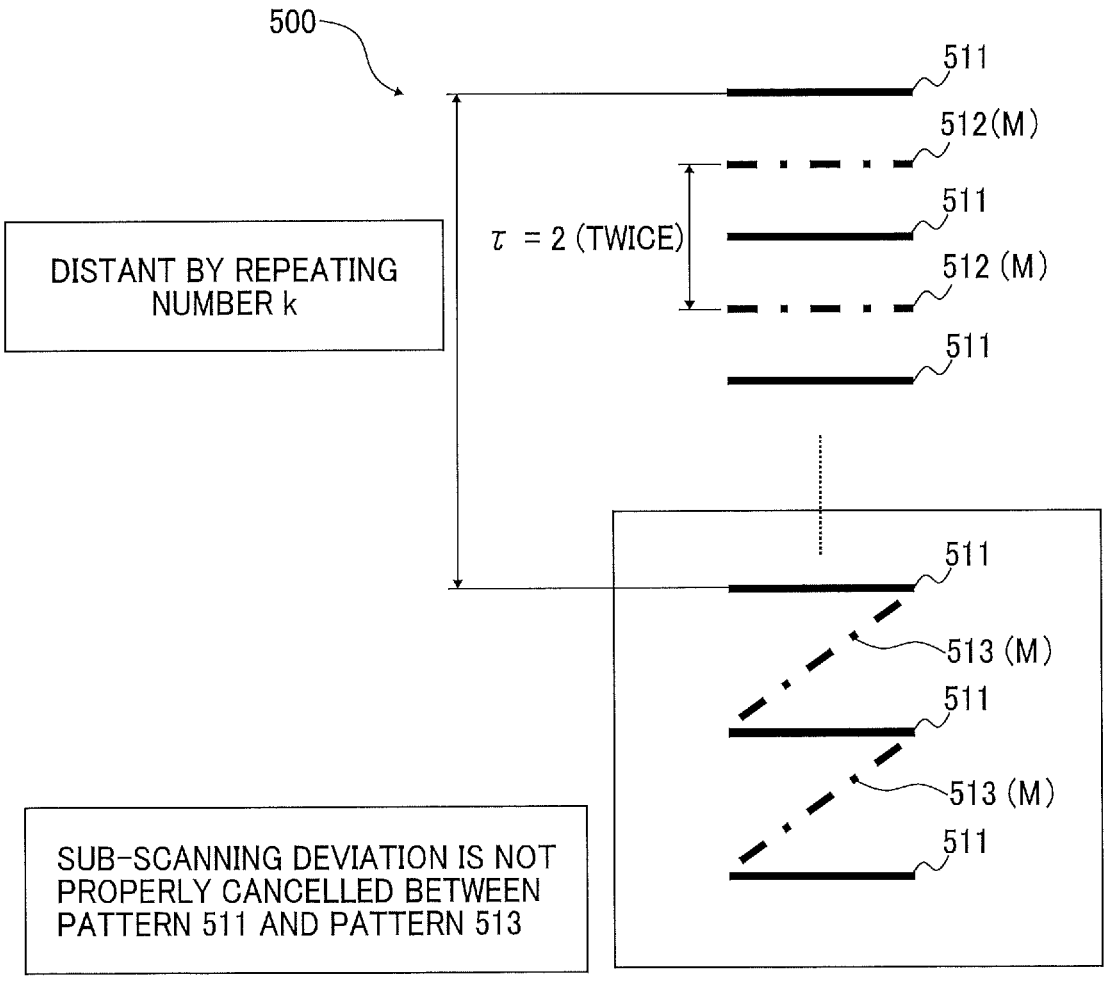
FIG. 13 is a diagram illustrating a countermeasure in the second comparative example with respect to the problem to be solved by an embodiment of the present disclosure.

In the case of the second comparative example, the influence of the speed fluctuation between the colors generated in the endless rotating body is more complicated as the formation of the detection patterns is more distant. For example, a case of a correction pattern 500 formed with a magnification parameter $\tau$ of "2" as illustrated in FIG. 13 is described below as an example. In such a case, the first combination pattern 521 and the second combination pattern 522 are formed at positions apart from each other by the number k of repeated formation. Accordingly, the first combination pattern 521 for correcting the positional deviation in the sub-scanning direction and the second combination pattern 522 for correcting the positional deviation in the main scanning direction are formed at positions where the running stability of the intermediate transfer belt 105 is greatly different. In addition, positional deviation components in the sub-scanning direction between the reference pattern 511 included in the pair of detection patterns and the diagonal line pattern 513 (magenta) as the pattern of the correction target color are not appropriately cancelled.

Accordingly, also in the second comparative example, it is difficult to improve the correction accuracy if deviations (registration deviations) in the main scanning direction and the sub-scanning direction are attempted to be simultaneously corrected.

Correction Pattern 500 According to First Embodiment

Figure 14:
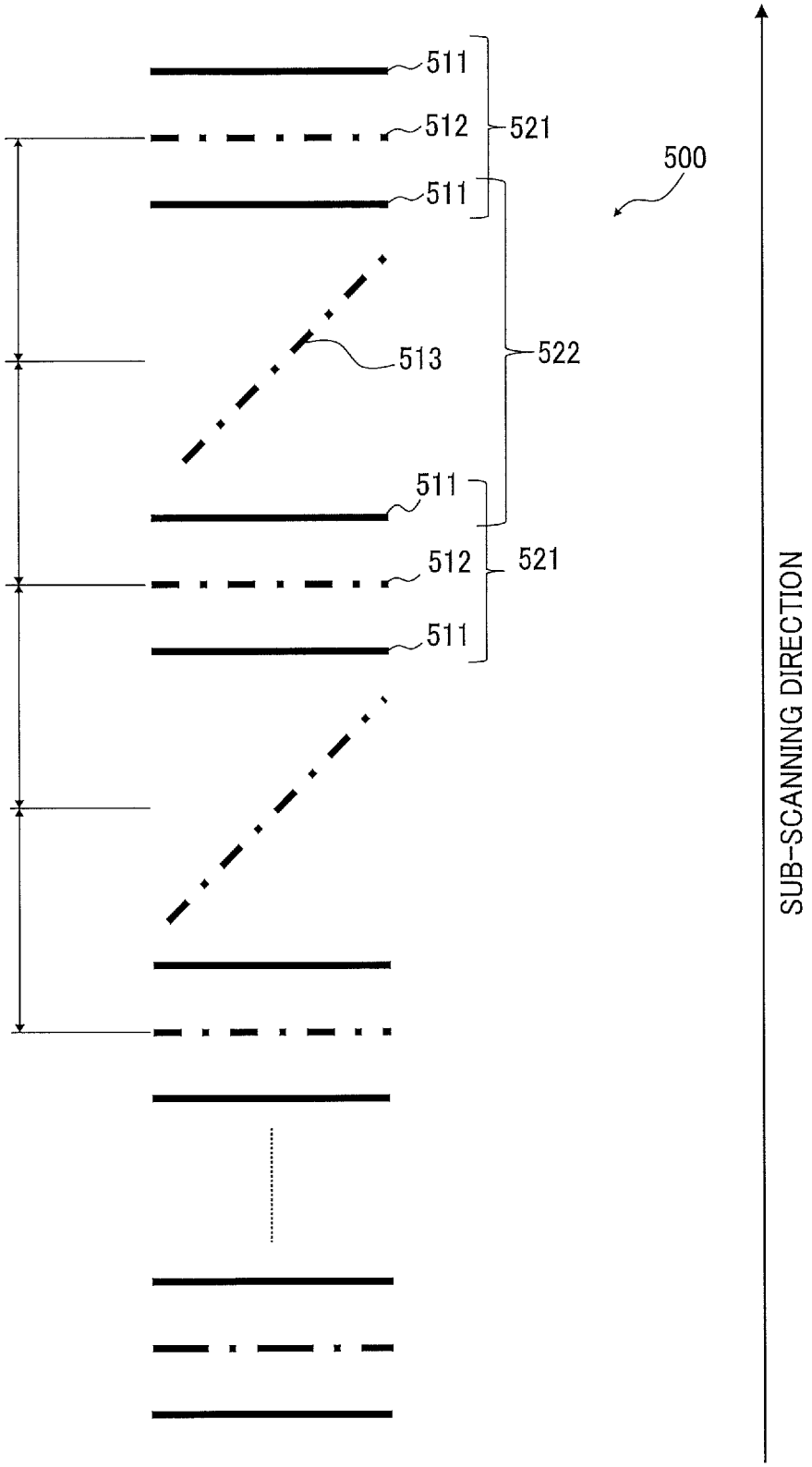
FIG. 14 is a diagram illustrating a first example of a correction pattern formed in the MFP of FIG. 1.

Based on the above situation, a method of forming the correction pattern 500 in the MFP 100 according to the present embodiment is described in detail. FIG. 14 illustrates the correction pattern 500 according to an embodiment of the present disclosure.

As illustrated in FIG. 14, the correction pattern 500 according to the present embodiment is formed by alternately repeating a first combination pattern 521 and a second combination pattern 522 in the sub-scanning direction. In the correction pattern 500 according to the present embodiment, the formation interval of two horizontal lines of the reference pattern 511 constituting the first combination pattern 521 is different from the formation interval of two horizontal lines of the reference pattern 511 constituting the second combination pattern 522. In other words, the formation interval of two horizontal lines of the reference pattern 511 constituting the first combination pattern 521 is shorter than the formation interval of two horizontal lines of the reference pattern 511 constituting the second combination pattern 522. In any of the combination patterns, the sensor control unit 123 serving as a pattern detection unit or pattern detection means uses the reference pattern 511 as a reference position of the correction pattern 500.

When the correction pattern 500 according to the present embodiment is formed in an ideal state in which the positional deviation of each color image due to the speed fluctuation of the endless rotating body does not occur (is absent), the formation position of the horizontal line pattern 512 or the diagonal line pattern 513 formed between two adjacent combination patterns is the center position of the two combination patterns in the conveyance direction. In other words, when the correction pattern 500 according to the present embodiment is formed in an ideal state in which the positional deviation of each color image due to the speed fluctuation of the endless rotating body does not occur (is absent), the formation interval of the combination patterns that are repeatedly formed becomes a constant interval.

As described in the description of the second comparative example, as the formation positions of the detection patterns are apart from each other (as the formation interval is increased), the influence of the speed fluctuation between colors is more complicated. Accordingly, it is advantageous that the formation positions of the detection patterns are closer to each other. Therefore, when the correction pattern 500 according to the present embodiment is formed, the magnitude of the "magnification parameter T" described in the second comparative example can be set to be small in the first combination pattern 521 and the second combination pattern 522 at the same time. Such a configuration can reduce the influence of speed fluctuation occurring between colors.

In FIG. 14, two horizontal lines of the reference pattern 511 and a horizontal line of the horizontal line pattern 512 drawn in a correction target color between the two horizontal lines of the reference pattern 511 constitute one set to form the first combination pattern 521. A diagonal line of the diagonal line pattern 513 drawn with the correction target color is formed at a position interposed between the first combination patterns 521 repeatedly formed. Alternatively, two horizontal lines of the reference pattern 511 and a diagonal line of the diagonal line pattern 513 drawn with the correction target color between two horizontal lines of the reference pattern 511 may form a second combination pattern 522 as a set. A horizontal line of the horizontal line pattern 512 drawn with the correction target color may be formed at a position interposed between the second combination patterns 522 repeatedly formed.

Although FIG. 14 illustrates an example of forming the correction pattern 500 in which the correction target color is magenta, the correction target color may be replaced with yellow (Y) or cyan (C). In the present embodiment, black (K) is described as the reference color. However, a color other than black (K) may be used as the reference color. When the diagonal line pattern 513 is repeatedly formed to form the correction pattern 500, the degree of inclination and the direction of inclination may not be the same but may be different.

Correction Pattern 500 According to Second Embodiment

Next, a description is given below of a method of forming a correction pattern 500 in the MFP 100 according to a second embodiment of the present disclosure. One advantage of the MFP 100 according to the present embodiment is that a writing start position deviation (registration deviation) can be corrected with high accuracy by one correction operation. Hence, as illustrated in FIG. 15, a description is given of a case where the correction pattern 500 is not formed of a single color but is formed while setting each color in turn as a correction target color. As illustrated in FIG. 15, forming the correction pattern 500 using each color as a correction target color allows efficient calculation of a correction value capable of correcting the writing start position deviation (registration deviation) of each color with high accuracy by one correction operation. Such a configuration can effectively restrain the positional deviation of each color image and exhibit high positioning accuracy by one correction operation.

Shortening the total length of the correction pattern 500 can reduce the downtime of the image forming process due to the process for reducing the positional deviation. Therefore, as illustrated in FIG. 15, the correction target color is set in accordance with the arrangement of the image forming stations of the respective colors from the upstream side in the rotation direction of the intermediate transfer belt 105, thus allowing the downtime to be most effectively reduced.

Correction Pattern 500 According to Third Embodiment

A description is given below of a method of forming the correction pattern 500 in the MFP 100 according to a third embodiment of the present disclosure. A first advantage of the MFP 100 according to the present embodiment is that the writing start position deviation (registration deviation) can be corrected with high accuracy by one correction operation.

Therefore, as described in the second embodiment, it is more advantageous to form the correction pattern 500 not in a single color but sequentially using each color in turn as a correction target color.

Figure 16:
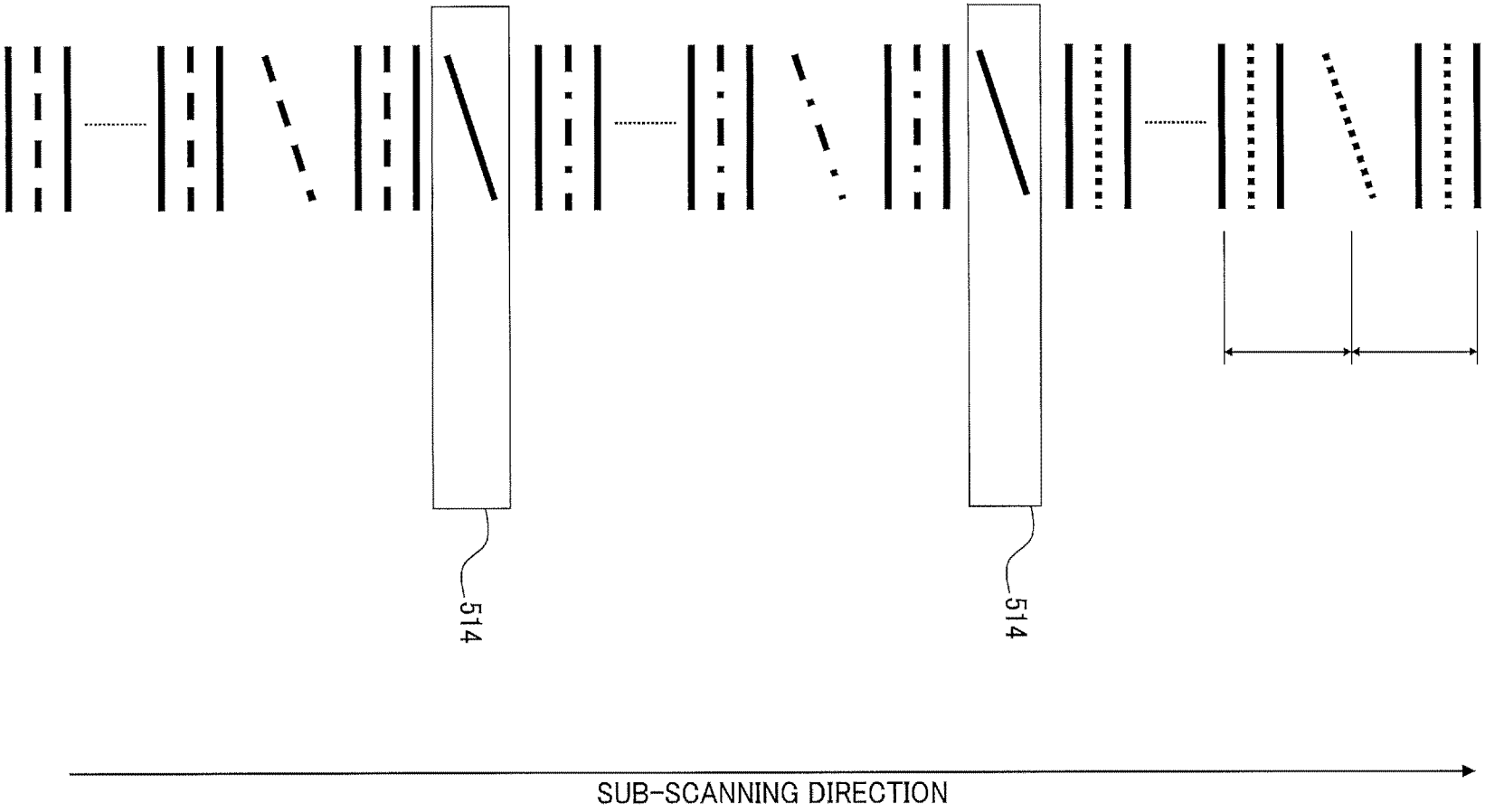
FIG. 16 is a diagram illustrating a third example of a correction pattern formed in the MFP of FIG. 1.

In such a case, particularly in a configuration in which the pattern lengths (intervals between reference colors) of the three-parallel-line pattern and the Z pattern are different from each other when the detection patterns are sequentially formed, the restriction on the position at which the diagonal line pattern of the necessary reference color (Bk) is inserted is strict. Therefore, as illustrated in FIG. 16, after the correction pattern 500 corresponding to a certain correction target color is drawn on the intermediate transfer belt 105, the black diagonal line pattern 514 as the reference color may be arranged before the correction pattern 500 corresponding to the next correction target color is drawn. Thus, the entire length of the correction pattern 500 can be further shortened.

In the third embodiment, the shape of the combination pattern for correcting the positional deviation is limited to the shape of the first combination pattern 521. If the shape of the combination pattern is the shape of the second combination pattern 522, the horizontal line pattern 512 is inserted while the correction target color is switched. Accordingly, there is no room for inserting the diagonal line pattern of the reference color (Bk).

Image Forming Method According to Embodiment

Figure 18:
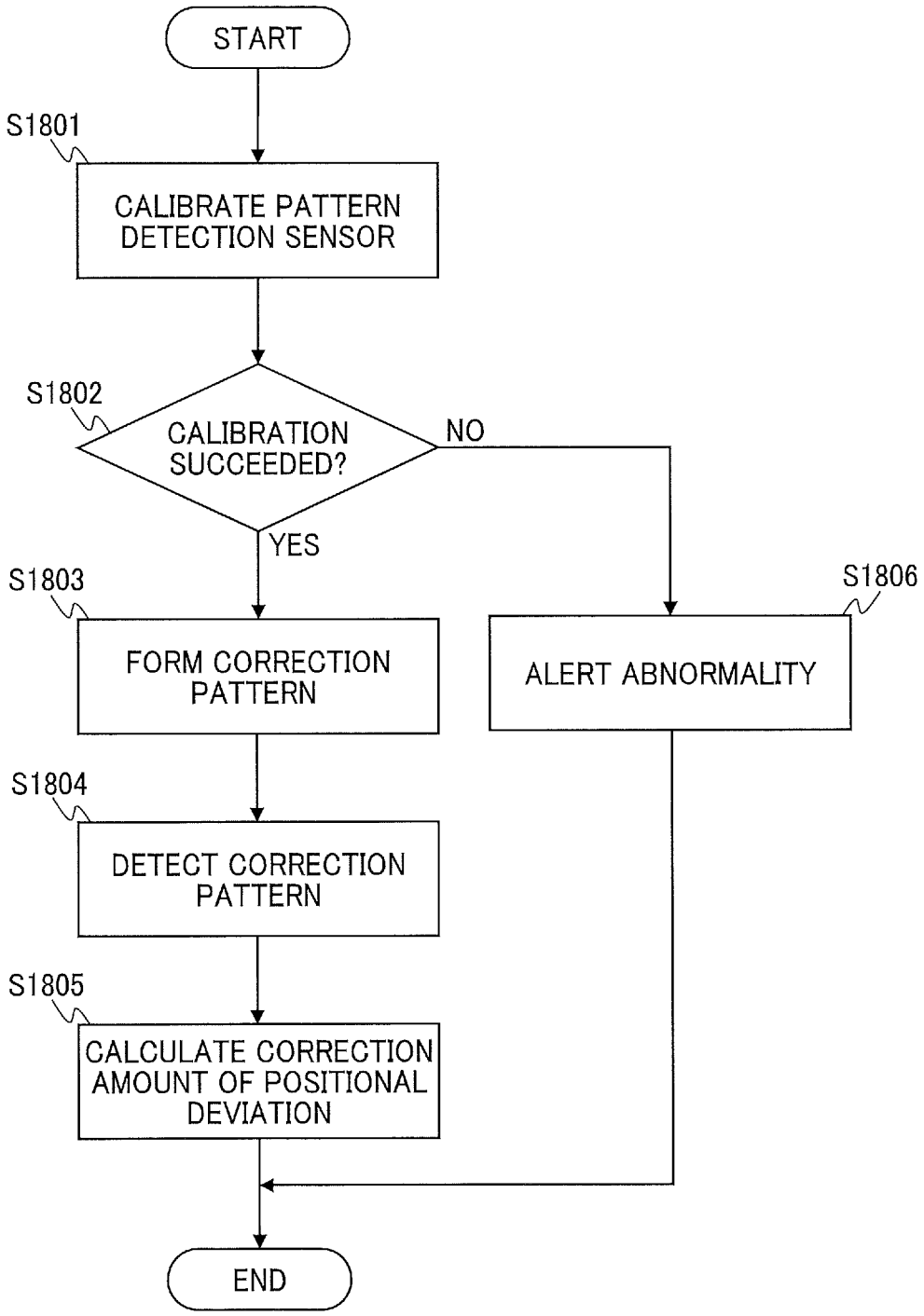
FIG. 18 is a flowchart of an image forming method according to an embodiment of the present disclosure.

As an image forming method according to an embodiment of the present disclosure, a flow of an alignment process using the correction pattern 500 according to the present embodiment is described with reference to a flowchart of FIG. 18. FIG. 18 illustrates a flow of processing for forming a plurality of sets of correction patterns (correction patterns 500) on the intermediate transfer belt 105, detecting the correction patterns 500 with the pattern detection sensors 117, and controlling the formation positions of the correction patterns 500 by the correction values calculated based on the detection results, in order to execute positional-deviation correction. Therefore, the processing flow illustrated in FIG. 18 exemplifies the formation processing of the correction pattern (correction pattern 500) formed when the alignment process is executed once (during the color matching operation).

First, calibration processing is executed so that the pattern detection sensors 117 can normally detect line patterns constituting the correction pattern 500 (step S1801). If the pattern detection sensors 117 are optical sensors, processing for adjusting the amount of irradiation, the gain of a detection signal, or the like is executed.

Next, it is determined whether the calibration process in step S1801 has been normally executed (step S1802). When the calibration process of the pattern detection sensors 117 cannot be normally executed (NO in step S1802), the process is interrupted and abnormality is notified with an alert notification device or alert notification means provided in the MFP 100 (step S1806).

When the calibration process of the pattern detection sensors 117 is normally performed (YES in step S1802), a process of forming the correction pattern 500 is performed (step S1803). In this process, a detection pattern generation function provided by a dedicated application-specific integrated circuit (ASIC) that controls the operation of the optical writing control device 111 is used. Alternatively, image data for a detection pattern may be prepared in advance and used to form a detection pattern. The image data for the detection pattern is image data corresponding to the Z pattern and the three-parallel-line pattern constituting the correction pattern 500.

Subsequently, the pattern detection sensors 117 detect the correction pattern 500 and notifies the correction-value calculating unit 124 of the calculation result via the sensor control unit 123 (step S1804).

Subsequently, the correction-value calculating unit 124 calculates the positional-deviation correction amount based on the detection results from the pattern detection sensors 117 and stores the calculated positional-deviation correction value in the correction-value storage unit 126 (step S1805). The MFP 100 including the optical writing control device 111 adjusts the image forming position using the positional-deviation correction values stored in the correction-value storage unit 126 when executing the image forming process.

The calibration process (step S1801) of the pattern detection sensor 117 may be periodically performed, and may not be performed every time the alignment process is performed. In such a case, when the calibration process (step S1801) is not performed, the process may be started from the pattern forming process (step S1803).

As described above, the correction pattern 500 is formed, the pattern detection sensors 117 perform pattern detection processing on the correction pattern 500, and the correction-value calculation unit 124 is notified of the calculation result via the sensor control unit 123. Subsequently, the correction-value calculation unit 124 calculates a positional-deviation correction amount based on the detection result from the pattern detection sensors 117 and stores the calculated positional-deviation correction value in the correction-value storage unit 126. The MFP 100 including the optical writing control device 111 adjusts the image forming position using the positional-deviation correction values stored in the correction-value storage unit 126 when the image forming process is executed. Accordingly, the positional deviation of each color image can be accurately restrained by the correction pattern 500 formed at one time when the alignment process is executed once, in other words in one cycle of the correction operation.

Embodiments of the present disclosure are not limited to the above-described embodiments, and various modifications can be made without departing from the technical scope of the present disclosure. While the above-described embodiments illustrate examples, a person skilled in the art can realize various modifications from the disclosed content. Such modifications are also included in the technical scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. An image forming apparatus configured to superimpose a plurality of color images each formed of a single-color developer to form a superimposed color image, the image forming apparatus comprising:

a transfer belt; and processing circuitry configured to form a correction pattern on the transfer belt, the correction pattern being for calculating a correction value used for a correction operation of correcting a positional deviation of each of the plurality of color images occurring when the plurality of color images are superimposed one on top of another onto the transfer belt, the transfer belt being at least one of endless rotating bodies used to superimposing processing of the plurality of color images, wherein the processing circuitry is configured to detect the correction pattern formed on the transfer belt and calculate the correction value based on a detection result of the correction pattern, wherein the processing circuitry is configured to form, as the correction pattern, a plurality of combination patterns arranged along a conveyance direction of the plurality of color images, the plurality of combination patterns including a first pattern, a second pattern, and a third pattern, wherein the first pattern includes horizontal lines arranged along the conveyance direction and parallel to a direction orthogonal to the conveyance direction, the second pattern includes horizontal lines arranged along the conveyance direction and parallel to the direction orthogonal to the conveyance direction, and the third pattern includes diagonal lines arranged along the conveyance direction and inclined with respect to the conveyance direction and the direction orthogonal to the conveyance direction, the third pattern having a same color as the second pattern, wherein, in each combination pattern of the plurality of combination patterns, one of a horizontal line of the second pattern and a diagonal line of the third pattern is placed between horizontal lines of the first pattern spaced away from each other in the conveyance direction, wherein the other one of the horizontal line of the second pattern and the diagonal line of the third pattern is not included in one combination pattern of the plurality of combination patterns formed on the transfer belt and another combination pattern of the plurality of combination patterns formed ahead of or behind the one combination pattern in the conveyance direction and is placed between the one combination pattern and said another combination pattern, and wherein a formation interval of the first pattern constituting the one combination pattern is shorter than a formation interval between one horizontal line of the first pattern constituting the one combination pattern and another horizontal line of the first pattern constituting said another combination pattern, the one horizontal line being opposite said another horizontal line.

2. The image forming apparatus according to claim 1, further comprising an image bearer on which an electrostatic latent image is formed by light from a light source whose light emission is controlled based on image information input from an outside of the image forming apparatus, wherein the image bearer is included in the endless rotating bodies.

3. The image forming apparatus according to claim 2, further comprising a charging roller configured to charge a surface of the image bearer, wherein the charging roller is included in the endless rotating bodies.

4. The image forming apparatus according to claim 1, wherein the endless rotating bodies includes a power transmitter configured to transmit power for rotating each of the endless rotating bodies including the transfer belt.

5. The image forming apparatus according to claim 1, wherein in the correction pattern formed in an ideal state in which the positional deviation does not occur, a formation position of one of the second pattern and the third pattern formed between two adjacent combination patterns is a center position of the two adjacent combination patterns in the conveyance direction.

6. The image forming apparatus according to claim 1, wherein the processing circuitry is configured to form the first pattern included in each of the one combination pattern and said another combination pattern with a color developer of a same color.

7. The image forming apparatus according to claim 6, wherein the processing circuitry is configured to form the first pattern with a reference color and the correction value by using the first pattern formed with the reference color as a reference position for alignment of a color image formed with another color different from the reference color.

8. The image forming apparatus according to claim 7, wherein the reference color is black.

9. The image forming apparatus according to claim 1, wherein, in the correction pattern in an ideal state in which the positional deviation does not occur, a formation interval of the plurality of combination patterns repeatedly formed is an equal interval.

10. The image forming apparatus according to claim 1, wherein the processing circuitry is configured to form the second pattern and the first pattern included in the one combination pattern with different colors.

11. The image forming apparatus according to claim 1, wherein in one cycle of the correction operation, the processing circuitry is configured to form the second pattern included in the correction pattern with all colors corresponding to the plurality of color images used for the superimposed color image.

12. The image forming apparatus according to claim 11, wherein in a case where the second pattern is a correction pattern included in the plurality of combination patterns, when the second pattern and the third pattern included in the correction pattern formed in one cycle of the correction operation are of two or more colors, the third pattern having a same color as the first pattern is placed between two combination patterns in which a color of the second pattern included in the one combination pattern is different from a color of the second pattern included in said another combination pattern adjacent to the one combination pattern in the conveyance direction.

13. The image forming apparatus according to claim 1, wherein when two or more colors of the second pattern and the third pattern included in the correction pattern are used in one cycle of the correction operation, the processing circuitry is configured to determine an arrangement order of colors of the second pattern and the third pattern in accordance with an arrangement order of a plurality of image forming devices that forms the plurality of color images, from an upstream side in the conveyance direction.

14. An image forming method for superimposing a plurality of color images each formed of a single-color developer to form a superimposed color image, the image forming method comprising:

forming a correction pattern on a transfer belt, the correction pattern being for calculating a correction value used for a correction operation of correcting a positional deviation of each of the plurality of color images occurring when the plurality of color images are superimposed one on top of another onto the transfer belt, the transfer belt being at least one of endless rotating bodies used to superimposing processing of the plurality of color images;

detecting the correction pattern formed on the transfer belt; calculating the correction value based on a detection result of the correction pattern; and forming, as the correction pattern, a plurality of combination patterns arranged along a conveyance direction of the plurality of color images, the plurality of combination patterns including a first pattern, a second pattern, and a third pattern, wherein the first pattern includes horizontal lines arranged along the conveyance direction and parallel to a direction orthogonal to the conveyance direction, the second pattern includes horizontal lines arranged along the conveyance direction and parallel to the direction orthogonal to the conveyance direction, and the third pattern includes diagonal lines arranged along the conveyance direction and inclined with respect to the conveyance direction, the third pattern having a same color as the second pattern, and wherein, in each combination pattern of the plurality of combination patterns, one of a horizontal line of the second pattern and a diagonal line of the third pattern is placed between horizontal lines of the first pattern spaced away from each other in the conveyance direction, wherein the other one of the horizontal line of the second pattern and the diagonal line of the third pattern is not included in one combination pattern of the plurality of combination patterns formed on the transfer belt and another combination pattern of the plurality of combination patterns formed ahead of or behind the one combination pattern in the conveyance direction and is placed between the one combination pattern and said another combination pattern, and wherein a formation interval of the first pattern constituting the one combination pattern is shorter than a formation interval between one horizontal line of the first pattern constituting the one combination pattern and another horizontal line of the first pattern constituting said another combination pattern, the one horizontal line being opposite said another horizontal line.

15. An image forming apparatus configured to superimpose a plurality of color images each formed of a single-color developer to form a superimposed color image, the image forming apparatus comprising:

pattern forming means for forming a correction pattern, the correction pattern being for calculating a correction value used for a correction operation of correcting a positional deviation of each of the plurality of color images occurring when the plurality of color images are superimposed one on top of another;

pattern detection means for detecting the formed correction pattern; and correction-value calculation means for calculating the correction value based on a detection result of the correction pattern, wherein the pattern forming means for forming, as the correction pattern, a plurality of combination patterns arranged along a conveyance direction of the plurality of color images, the plurality of combination patterns including a first pattern, a second pattern, and a third pattern, wherein the first pattern includes horizontal lines arranged along the conveyance direction and parallel to a direction orthogonal to the conveyance direction, the second pattern includes horizontal lines arranged along the conveyance direction and parallel to the direction orthogonal to the conveyance direction, and the third pattern includes diagonal lines arranged along the conveyance direction and inclined with respect to the conveyance direction and the direction orthogonal to the conveyance direction, the third pattern having a same color as the second pattern, wherein, in each combination pattern of the plurality of combination patterns, one of a horizontal line of the second pattern and a diagonal line of the third pattern is placed between horizontal lines of the first pattern spaced away from each other in the conveyance direction, wherein the other one of the horizontal line of the second pattern and the diagonal line of the third pattern is not included in one combination pattern of the plurality of formed combination patterns and another combination pattern of the plurality of combination patterns formed ahead of or behind the one combination pattern in the conveyance direction and is placed between the one combination pattern and said another combination pattern, and wherein a formation interval of the first pattern constituting the one combination pattern is shorter than a formation interval between one horizontal line of the first pattern constituting the one combination pattern and another horizontal line of the first pattern constituting said another combination pattern, the one horizontal line being opposite said another horizontal line.

16. The image forming apparatus according to claim 15, further comprising an image bearer on which an electrostatic latent image is formed by light from a light source whose light emission is controlled based on image information input from an outside of the image forming apparatus, wherein the image bearer is included in the endless rotating bodies.

17. The image forming apparatus according to claim 16, further comprising a charging roller configured to charge a surface of the image bearer, wherein the charging roller is included in the endless rotating bodies.

18. The image forming apparatus according to claim 15, wherein the endless rotating bodies includes a power transmitter configured to transmit power for rotating each of the endless rotating bodies.

19. The image forming apparatus according to claim 15, wherein in the correction pattern formed by the pattern forming means in an ideal state in which the positional deviation does not occur, a formation position of one of the second pattern and the third pattern formed between two adjacent combination patterns is a center position of the two adjacent combination patterns in the conveyance direction.

20. The image forming apparatus according to claim 15, wherein the pattern forming means is for forming the first pattern included in each of the one combination pattern and said another combination pattern with a color developer of a same color.

* * * * *